US012419364B2

(12) United States Patent
Burton et al.

(10) Patent No.: US 12,419,364 B2
(45) Date of Patent: Sep. 23, 2025

(54) KNIT BRA

(71) Applicant: NIKE, Inc., Beaverton, OR (US)

(72) Inventors: Jesse L. Burton, Portland, OR (US); Paul R. Montgomery, Portland, OR (US); Tara Pennington, Portland, OR (US); Amy X. Toth, Portland, OR (US); Samantha Woodard, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 370 days.

(21) Appl. No.: 17/526,310

(22) Filed: Nov. 15, 2021

(65) Prior Publication Data

US 2022/0192280 A1 Jun. 23, 2022

Related U.S. Application Data

(60) Provisional application No. 63/119,378, filed on Nov. 30, 2020.

(51) Int. Cl.

| | |
|---|---|
| ***A41C 3/00*** | (2006.01) |
| ***A41C 5/00*** | (2006.01) |
| ***D04B 1/24*** | (2006.01) |
| ***D04B 7/30*** | (2006.01) |

(52) U.S. Cl.

CPC ..... *A41C 3/0014* (2013.01); *A41C 5/00* (2013.01); *D04B 1/246* (2013.01); *D04B 7/30* (2013.01); *D10B 2403/022* (2013.01)

(58) Field of Classification Search

USPC ..... 450/75, 76

See application file for complete search history.

(56) References Cited

U.S. PATENT DOCUMENTS

| | | | | |
|---|---|---|---|---|
| 2,655,020 A * | 10/1953 | Allen | D04B 11/28 | 66/178 R |
| 6,176,761 B1 * | 1/2001 | Underhill | A41C 3/0014 | 450/1 |
| 7,028,509 B2 * | 4/2006 | Mitchell | A41C 3/0014 | 66/196 |

(Continued)

FOREIGN PATENT DOCUMENTS

| | | |
|---|---|---|
| CN | 110612368 A | 12/2019 |
| CN | 211199600 U | 8/2020 |

(Continued)

OTHER PUBLICATIONS

International Preliminary Report on Patentability received for PCT Patent Application No. PCT/US2021/059526 mailed on Jun. 15, 2023, 9 Pages.

(Continued)

*Primary Examiner* — Grace Huang

(74) *Attorney, Agent, or Firm* — Shook, Hardy & Bacon L.L.P.

(57) ABSTRACT

Aspects herein are directed to a bra having a front portion with a double-knit structure having different ratios of float stitches to tuck stitches within intermediate courses within the double-knit structure. The front portion includes a Y-shaped region and a first breast-contacting region, where intermediate courses have a greater ratio of float stitches to tuck stitches within the Y-shaped region than within the first breast-contacting region.

20 Claims, 11 Drawing Sheets

(56) References Cited

U.S. PATENT DOCUMENTS

| | | | | |
|---|---|---|---|---|
| 7,611,999 | B2 * | 11/2009 | McMurray | D04B 1/126 66/196 |
| 7,614,256 | B2 * | 11/2009 | Mitchell | D04B 1/102 66/179 |
| 8,075,368 | B2 * | 12/2011 | Puyaubreau | A41C 3/14 450/72 |
| 10,145,042 | B2 * | 12/2018 | Diaz | A41C 3/0057 |
| 10,179,960 | B2 * | 1/2019 | Diaz | A41C 3/0057 |
| 10,244,801 | B2 * | 4/2019 | Witek | A41C 3/12 |
| 10,368,590 | B2 * | 8/2019 | Diaz | D04B 35/10 |
| 10,912,340 | B2 * | 2/2021 | Diaz | D04B 1/246 |
| 11,497,255 | B2 * | 11/2022 | Begriche | A61B 5/296 |
| 11,819,064 | B2 * | 11/2023 | Montgomery | D04B 1/246 |
| 2003/0082994 | A1 | 5/2003 | Mitchell et al. | |
| 2004/0110447 | A1 * | 6/2004 | Mitchell | A41C 3/0007 450/75 |
| 2013/0045651 | A1 * | 2/2013 | Esteves De Sousa Fangueiro | D04B 1/16 66/196 |
| 2021/0140079 | A1 * | 5/2021 | Szilagyi | A43B 23/0245 |
| 2023/0232912 | A1 | 7/2023 | Roeleveld et al. | |
| 2023/0301370 | A1 * | 9/2023 | Gunasekara | A41C 3/0014 |

FOREIGN PATENT DOCUMENTS

| | | | |
|---|---|---|---|
| CN | 111713761 | A | 9/2020 |
| CN | 211932605 | U | 11/2020 |
| EP | 4176115 | A1 | 5/2023 |
| JP | 2006-511720 | A | 4/2006 |
| JP | 2020-519776 | A | 7/2020 |
| WO | 2020/112243 | A1 | 6/2020 |
| WO | 2023/014281 | A1 | 2/2023 |

OTHER PUBLICATIONS

International Search Report and Written Opinion received for PCT Patent Application No. PCT/US2021/059526, mailed on Feb. 18, 2022, 14 pages.

Office action received for Canadian Patent Application No. 3197885, mailed on Aug. 14, 2024, 3 pages.

* cited by examiner

KNIT BRA

CROSS-REFERENCE TO RELATED APPLICATIONS

This application entitled "Knit Bra," claims the benefit of priority of U.S. Prov. App. No. 63/119,378, entitled "Knit Bra," and filed Nov. 30, 2020. The entirety of the aforementioned application is incorporated by reference herein.

TECHNICAL FIELD

Aspects herein relate to a knit bra with zonal properties and a method of manufacturing a knit bra with zonal properties.

BACKGROUND

Traditional bras, including sports bras, typically offer varying levels of support through different fabric pieces stitched together. This type of construction creates multiple seam lines that may cause wearer discomfort and increase costs and time in the production process. Additionally, traditional bras are manufactured in one knitting direction, which reduces the ability to create different structures in an efficient manner.

BRIEF DESCRIPTION OF THE DRAWINGS

Examples of aspects herein are described in detail below with reference to the attached drawings figures, wherein.

DETAILED DESCRIPTION

Figure 1:
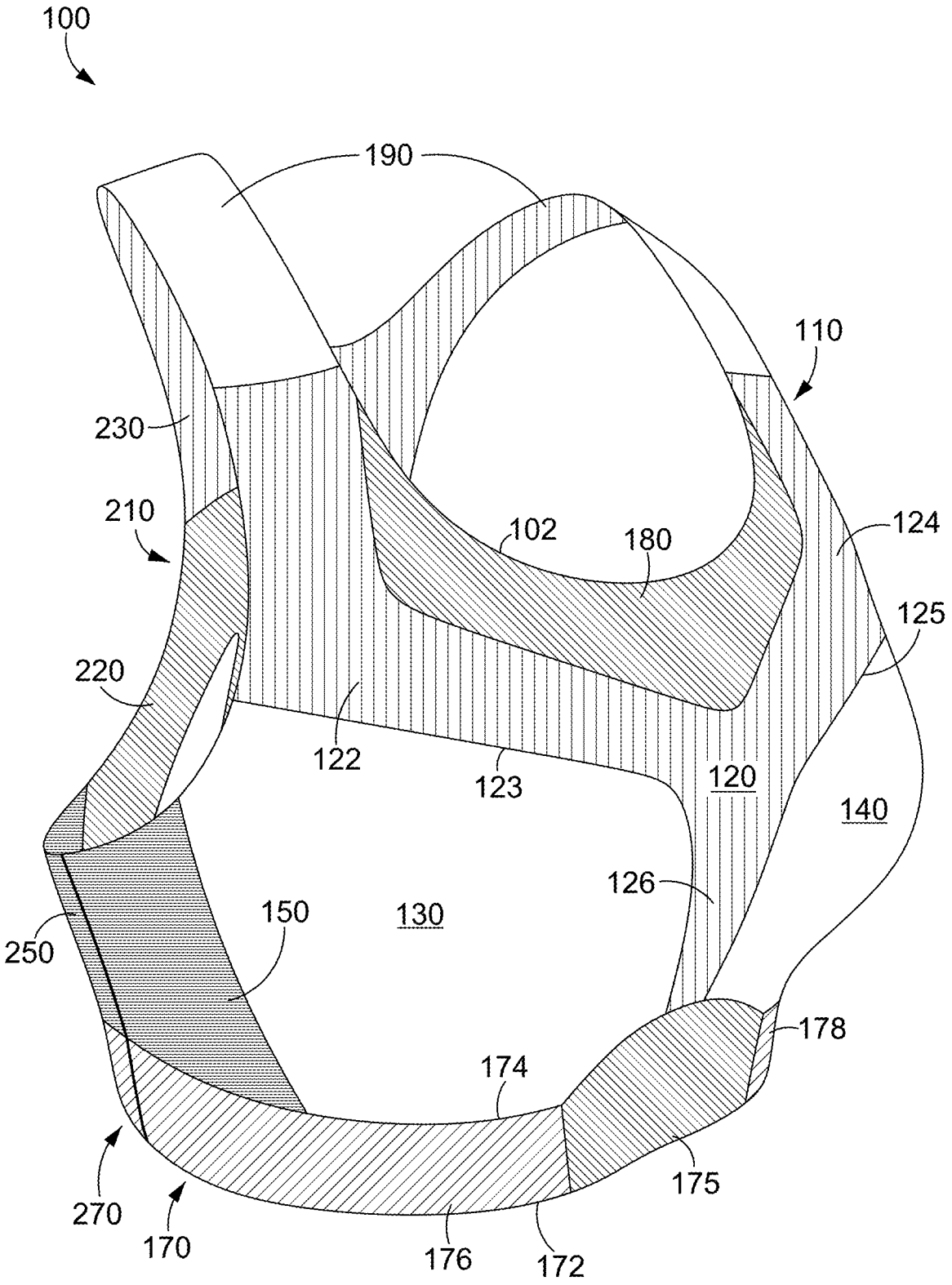
FIG. 1 illustrates a front perspective view of an example knit bra in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to identify different elements of methods employed, the terms should not be interpreted as implying any particular order among or between various steps herein disclosed unless and except when the order of individual steps is explicitly stated.

Bras that are worn during athletic activities, such as sport bras, generally need to provide greater support in some regions and greater stretch in other regions to sufficiently support the wearer's breasts while allowing some mobility and flexibility, particularly when the wearer dons and doffs the bra. Traditional bras typically offer varying levels of support through different fabric pieces stitched together. This type of construction creates multiple seam lines that may cause wearer discomfort and increase the cost and time in the production process. Additionally, traditional bras are conventionally manufactured by knitting in one direction, even when pieces are knitted separately, such that knit courses in the bra generally extend in a common direction. Utilizing the same knitting direction for the entire bra reduces the ability to efficiently integrally knit different types of structures of the bra.

At a high level, aspects herein are directed to a bra that includes at least a double-knit front portion. The front portion has a first breast-contacting region and a Y-shaped region, which has an upper right portion, an upper left portion, and a lower central portion. Both the Y-shaped region and first breast-contacting region have front courses, back courses, and intermediate courses extending at least partially between the front and back courses. For example, the double-knit front portion forming the Y-shaped region and the first breast-contacting region may include a plurality of front courses formed by a first yarn, a plurality of back courses formed by a second yarn, and a plurality of intermediate courses formed by a third yarn interlooping with the plurality of front courses and the plurality of back courses. In example aspects, the first yarn, the second yarn, and the third yarn are each a polyester material. Additionally, the front courses form a front layer of the double-knit front portion, and the back courses form a back layer of the double-knit front portion. One or more of the intermediate courses each has one or more float stitches and one or more tuck stitches in which the third yarn forms a loop within the front layer or back layer. In example aspects, the float stitches formed by the third yarn are positioned entirely between the front layer and the back layer.

The ratio of float stitches to tuck stitches within the one or more intermediate courses may vary across regions within the double-knit front portion. In example aspects, the ratio of float stitches to tuck stitches within the Y-shaped region is greater than the ratio of float stitches to tuck stitches within the first breast-contacting region. Varying the ratio of float stitches to tuck stitches between the Y-shaped region and first breast-contacting region may provide different functional and visual properties to those regions within the double-knit front portion. In example aspects, varying the ratios may vary the degrees of stretch resistance within the regions and/or may provide a visual indicator of regions with different properties. For example, in example aspects, the third yarn forming the intermediate courses is a different color than the first yarn forming the front courses and the second yarn forming the back courses such that a greater ratio of float stitches to tuck stitches reduces the appearance of the third yarn color within the Y-shaped region relative to the first breast-contacting region, thereby providing a visual indicator of the Y-shaped region and the first breast-contacting region. Further, in some aspects, the Y-shaped region may have a greater modulus of elasticity than the first breast-contacting region at least partly due to a greater ratio of float stitches to tuck stitches. Additionally or alternatively, a higher modulus of elasticity of the Y-shaped region may be at least partly due to a shorter knit stitch length (e.g., due to increased yarn tension during knitting) compared to the first breast-contacting region.

The double-knit front portion may also include a second breast-contacting region that is separated from the first breast-contacting region by at least part of the lower central portion of the Y-shaped region. The one or more intermediate courses may also have a lower ratio of float stitches to tuck stitches within the second breast-contacting region relative to the Y-shaped region. The ratio of float stitches to tuck stitches within the second breast-contacting region may be the same or substantially the same as the ratio within the first breast-contacting region.

Further, in some aspects, the double-knit front portion includes a first wing region and a second wing region positioned laterally to the respective breast-contacting region. For example, the first wing region may be separated from at least the lower central portion of the Y-shaped region by the first breast-contacting region, while the second wing region may be separated from at least the lower central portion of the Y-shaped region by the second breast-contacting region. The one or more intermediate courses may also have a greater ratio of float stitches to tuck stitches within the first wing region relative to the first breast-contacting region and a greater ratio of float stitches to tuck stitches within the second wing region relative to the second breast-contacting region. In example aspects, the ratio of float stitches to tuck stitches is the same or substantially the same within the first wing region and the second wing region. Additionally, the ratio of float stitches to tuck stitches within the first and second wing regions may be the same or substantially the same as the ratio within the Y-shaped region.

Example aspects of the present disclosure also include a method of manufacturing a knit bra with different ratios of float stitches to tuck stitches. The method may include knitting a front portion of the bra. The front portion includes a first breast-contacting region and a Y-shaped region. In example aspects, knitting the front portion of the bra includes knitting a plurality of front courses with a first yarn, knitting a plurality of back courses with a second yarn, and knitting a plurality of intermediate courses with a third yarn intermittently interlooping with the plurality of front courses and the plurality of back courses. One or more intermediate courses of the plurality of intermediate courses may each be knitted with one or more tuck stitches and one or more float stitches. As such, the one or more intermediate courses may each have a first ratio of float stitches to tuck stitches within the Y-shaped region and a second ratio of float stitches to tuck stitches within the first breast-contacting region, where the first ratio is greater than the second ratio.

A method of manufacturing according to some aspects of present disclosure may further include kitting a second breast-contacting region, a first wing region, and a second wing region. As previously described, some aspects include the second breast-contacting region having a lesser ratio of float stitches to tuck stitches than the Y-shaped region and, in some aspects, the first wing region and the second wing region.

The method of manufacturing may further include knitting a back portion, which may be a double-knit material comprising a second plurality of front courses and a second plurality of back courses. The back portion may also be knitted to include a second plurality of intermediate courses intermittently interlooped with the second plurality of front courses and the second plurality of back courses, where one or more intermediate courses in the back portion may include one or more tuck stitches and one or more float stitches.

Additional aspects of the disclosure include a bra in which the front portion and the back portion are knitted in different knitting directions. For example, aspects may include a bra having a knit front portion with courses extending along a first direction and a knit back portion with courses extending along a second direction that is orthogonal to the first direction. In example aspects, the front portion of the bra has courses extending horizontally when in an as-worn configuration, and the back portion has courses extending vertically when in an as-worn configuration. Utilizing the first direction for the front portion of the bra may aid in providing sufficient support in the vertical direction while allowing for sufficient stretch in the horizontal direction to aid in mobility and donning and doffing the bra. Utilizing the second direction for the back portion may allow strap portions separated by large openings to be knitted efficiently with less instances of binding off the yarn. Additionally, knitting the back portion so that the courses extend in the second direction reduces the need for multiple yarn carriers when switching yarns for the strap portions.

Some further aspects of this disclosure include a method of manufacturing a bra with different knit directions. The method may include knitting a front portion of the bra by forming a first plurality of courses extending along a first direction and knitting a back portion of the bra by forming a second plurality of courses extending along a second direction. The front portion and the back portion may be joined such that, when joined, the first direction of the first plurality of courses is orthogonal to the second direction of the second plurality of courses.

As used herein, the term "bra" encompasses any structure configured to be worn around a wearer's torso and at least partially cover the wearer's breasts. Although aspects herein are discussed with respect to a bra, it is understood that the disclosed technology is not limited to a bra and may be applied to any upper-torso garment used to support breast tissue, such as camisoles, swimwear, tank tops, or other garments with built-in breast support. The term "breast-covering region" means the portion of the bra that substantially covers a wearer's breast. Thus, as used herein the first breast-covering region is configured to substantially cover a wearer's right breast, and the second breast-covering region is configured to substantially cover a wearer's left breast. The term "wing region" as used herein is that portion of the bra that extends between the front portion and the back portion of the bra along the side torso areas of a wearer when the bra is worn. Thus, as used herein, the first wing region is configured to be positioned adjacent to a wearer's right side below the wearer's right axilla, and the second wing region is configured to be positioned adjacent to a wearer's left side below the wearer's left axilla.

Positional terms used when describing the bra, such as front, sides, back, superior, inferior, top, bottom, upper, lower, lateral, right, left, inner-facing, and outer-facing and the like, are used with respect to the bra being worn as intended with the wearer standing upright such that the lower portion of the bra extends around the wearer's torso and the upper portion of the bra is positioned generally over the wear's chest. Additionally, the front portion of the bra is configured to at least partially cover the wearer's breasts while the back portion is configured to at least partially cover the wearer's back. Additionally, shoulder straps are configured to extend over the wearer's shoulder from the front portion to the back portion and at least partly define openings through which the wearer's arms extend and an opening through which the wearer's head and neck extend. It should be understood, however, that use of positional terms do not depend on the actual presence of a human being for interpretative purposes.

The term "course," as used herein, refers to a predominantly horizontal row of knit loops (in an upright textile as knit) that are produced by adjacent needles during the same knitting cycle. The knit course may comprise one or more stitch types such as a knit stitch, a held stitch, a float stitch, a tuck stitch, a transfer stitch, a rib stitch, and the like as these terms are known in the art of knitting. The term "knit stitch" as used herein refers to the basic stitch type where the yarn is cleared from the needle after pulling a loop of the yarn from the back to the front of the textile through a previous stitch. The term "wale," as used herein, is a predominantly vertical column of intermeshed or interlooped knit loops, generally produced by the same needle at successive (but not necessarily all) courses or knitting cycles. The terms "horizontal" and "vertical" as used herein are relative to an upright textile as knit in which the heads of knit loops face toward the top of the textile and the course knit first is oriented toward the bottom of the textile.

As used herein, the term "double-knit textile" means a textile knit on a machine with two sets of needles in two needle beds or cylinders. Aspects herein contemplate the machine comprising a weft knit (flat knit) machine. The term "bed" is typically used when describing flat knit machines. To describe a double-knit textile in a different way, the term double-knit textile means a textile having front courses formed on one needle bed and back courses formed on a second needle bed. The front courses of a double-knit textile are courses of interlooped stitches forming a front layer of the textile, and the back courses are courses of interlooped stitches forming a back layer of the textile such that the front layer and the back layer of the textile may be formed at substantially the same time. As used herein, the term "front layer" refers to a textile layer that is configured to face externally when the garment incorporating the textile, such as the bra, is worn, and the term "back layer" refers to a textile layer that is configured to be positioned adjacent a skin surface of the wearer when the garment is worn.

The term "integrally knit," as used herein, may mean a knit textile having a yarn from one or more knitted courses in a first area being interlooped with one or more knitted courses of another area. The interlooping may be through a simple knit stitch, a tuck stitch, a held stitch, a float or miss stitch, and the like. In this way, areas that are integrally knit together have a seamless transition.

The term "knitting direction," as used herein, refers to the direction on a knit garment, such as a bra, in which courses are sequentially knitted when the garment is in an as-worn configuration. For instance, where courses forming the top of an integrally knit garment panel are knit prior to courses forming the bottom the garment panel, the knitting direction may be considered either top to bottom or, more generally, vertical; whereas, when courses forming a right side of an integrally knit garment panel are knit prior to courses forming the left side, the knitting direction may be considered either right to left or, more generally, horizontal.

The term "tuck stitch", as used herein, refers to a loop made by a yarn forming an intermediate course. A tuck stitch is formed when a needle, either on the front needle bed or back needle bed, that is already holding a loop receives a further loop from an intermediate course. As such, the loop forming the tuck stitch coincides with another loop formed either by a front yarn on the front needle bed or a back yarn on the back needle bed.

The term "float stitch", as used herein, refers to a portion of a yarn formed when a yarn is not looped around or "misses" one or more needles during knitting. A float stitch, as referred to herein, may be a portion of a yarn that forms an intermediate course, where that portion is floated between front and back layers of a double-knit textile.

The term "ratio of float stitches to tuck stitches", as used herein, refers to a quantity of stitch positions forming float stitches to a quantity of stitch positions forming tuck stitches within a designated area (e.g., a 1 cm×1 cm square). Generally, each tuck stitch is formed at one stitch position such that the quantity of tuck stitch positions is equal to the quantity of tuck stitches. One float stitch may extend across one or more than one stitch position. For example, a two-needle float stitch is a float stitch formed by missing two consecutive needles and, therefore, expands two float stitch positions. As an example, an area with two two-needle float stitches and four tuck stitches has a ratio of 1:1.

The term "knit stitch length," as used herein, refers to the length of a portion of a yarn strand in a single knitted loop. Knit stitch length may be decreased by an increase in tension during knitting.

The term "mesh," as used herein, refers to a textile material with a plurality of closely-spaced openings. The mesh material may be knitted (warp knitted or weft knitted) or woven. In example aspects, the term mesh refers to a loosely woven or knit material such that the openings are integrally knit or woven into the material. In other aspects, the openings may be formed in a post-knitting or post-weaving step using, for example, laser cutting, water jet cutting, die cutting, and the like after the textile is woven or knitted.

The term "rib," as used herein, refers to a knitted ridge structure that extends in the wale direction and is created by an alternating pattern of knit stitches and purl stitches.

Additionally, there are various numerical measurements provided herein. Unless indicated otherwise, the term "about" or "substantially" with respect to a measurement means within ±10% of the indicated value. Further, unless indicated otherwise, all measurements provided herein are with respect to the bra being in a resting state (i.e., a non-stretched) at standard ambient temperature and pressure (298.15 K and 100 kPa).

Figure 2:
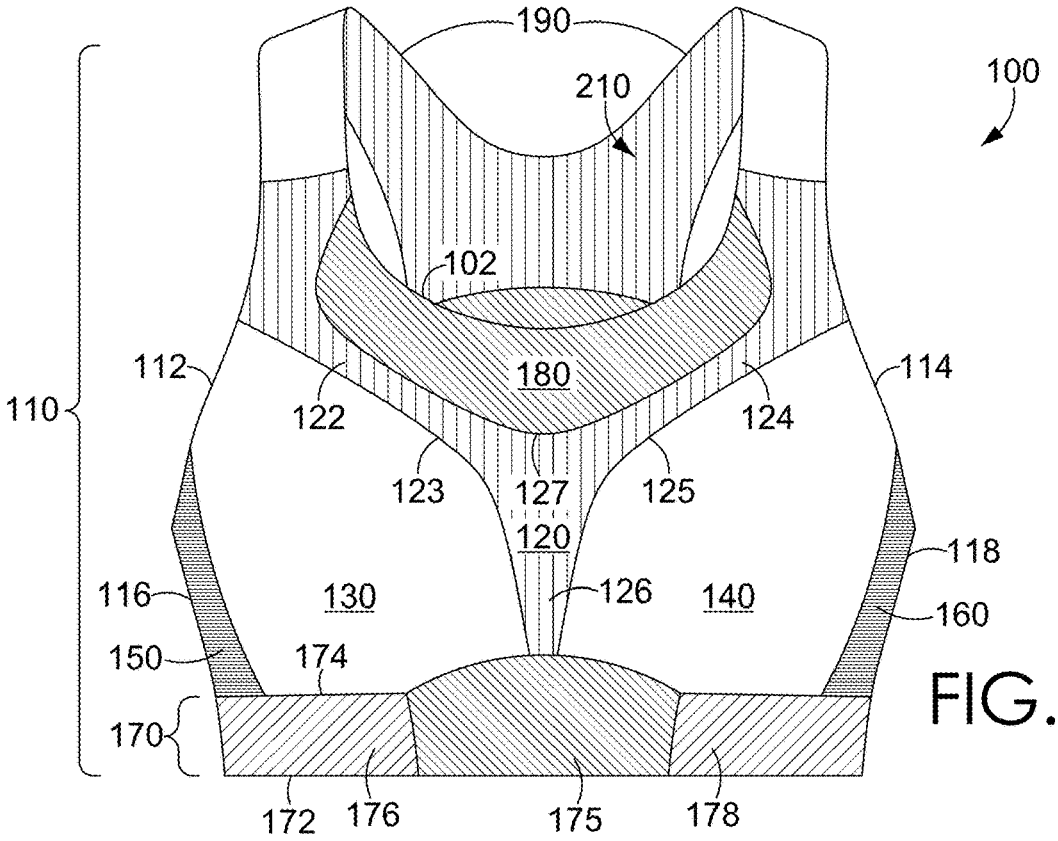
FIG. 2 illustrates a front view of the bra of FIG. 1 in accordance with aspects herein.
Figure 3:
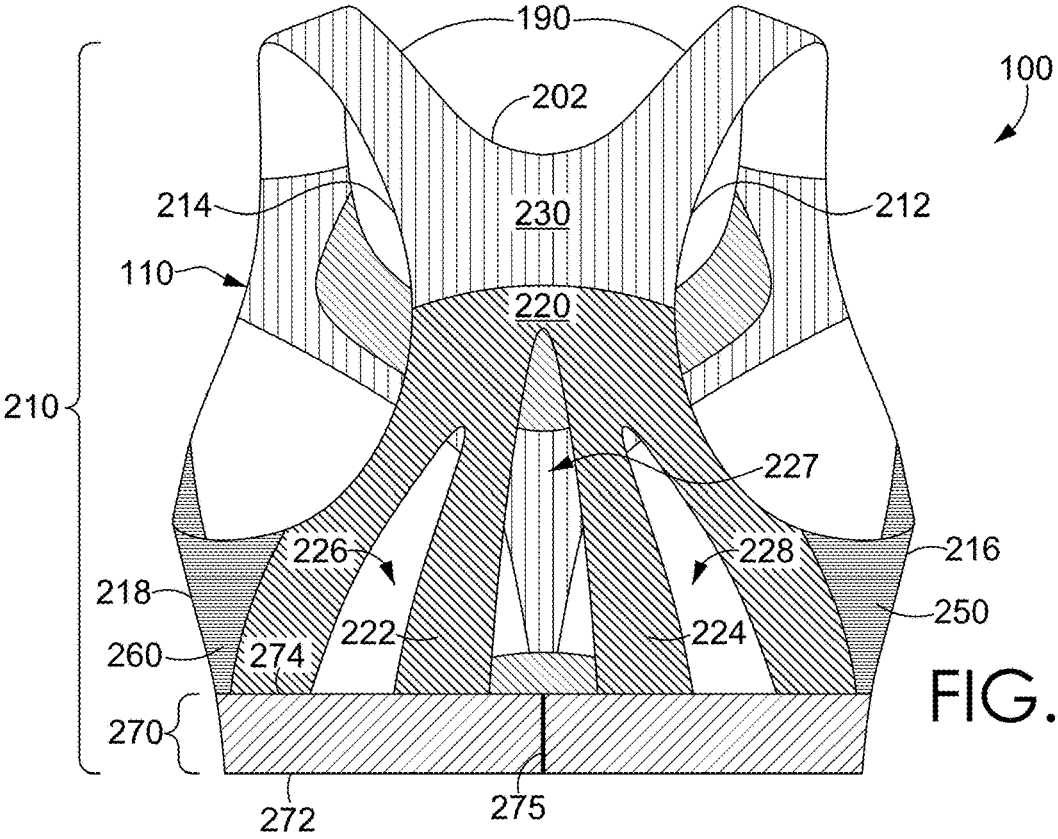
FIG. 3 illustrates a back view of the bra of FIG. 1 in accordance with aspects herein.

FIGS. 1-3 depict a front perspective view, a front view, and a back view, respectively, of an example bra 100. The bra 100 includes a front portion 110 that typically covers at least a portion of the wearer's chest when the bra 100 is in an as-worn configuration and a back portion 210 that typically covers at least a portion of the wearer's back when the bra 100 is in the as-worn configuration. The bra 100 may also include a pair of shoulder straps 190, each extending between the front portion 110 and the back portion 210.

The front portion 110 generally extends from a first armhole edge 112 to a second armhole edge 114, from a first front lateral edge 116 to a second front lateral edge 118, and from a neckline edge 102 to a bottom chestband edge 172.

The shoulder straps 190 extend from the upper part of the front portion 110. A front chestband region 170 defined by a top chestband edge 174 and the bottom chestband edge 172 forms a lower area of the front portion 110 such that the bottom chestband edge 172 forms an inferior margin of the front portion 110.

The back portion 210 extends from shoulder straps 190 joining the back portion 210 to the front portion 110. The back portion 210 generally extends from a first armhole edge 212 to a second armhole edge 214, from a first back lateral edge 216 to a second back lateral edge 218, and from a neckline edge 202 to a bottom chestband edge 272. In example aspects, the first back lateral edge 216 and the second back lateral edge 218 may each comprise a seamed edge where the back portion 210 is joined to the front portion 110 along the first front lateral edge 116 and the second front lateral edge 118. Alternatively, the first back lateral edge 216 and the second back lateral edge 218 may comprise a hypothetical boundary demarcating the limits of the back portion 210, while the first front lateral edge 116 and the second front lateral edge 118 may comprise a hypothetical boundary demarcating the limits of the front portion 110. A back chestband region 270 defined by a top chestband edge 274 and a bottom chestband edge 272 forms a lower area of the back portion 210 such that bottom chestband edge 272 forms an inferior margin of the back portion 210.

The bra 100 may also include one or more mechanisms for adjusting the fit of the bra 100 on a wearer. For example, the shoulder straps 190 may each include a strap adjustment mechanism, such as a slider. Additionally, the back chestband region 270 may include a closure mechanism 275, such as one or more hook and eye structures, that releasably couple two sections of the back chestband region 270.

In example aspects, each of the front portion 110 and the back portion 210 of the bra 100 generally comprises a double-knit textile structure with front courses forming a front layer and back courses forming a back layer. The front layer may be an outer-facing layer of the bra 100, while the back layer may be an inner-facing layer of the bra 100. Further, each of the front portion 110 and the back portion 210 may include regions with different knit structures to provide zonal properties. Additionally, the regions within the front portion 110 disclosed herein may be integrally knit, and the regions within the back portion 210 disclosed herein may be integrally knit. In example aspects, for instance and as described further herein, the double-knit textile structure of the front portion 110 may include one or more intermediate courses generally positioned between the front and back courses and that include a stitch sequence of interlocking tuck stitches or a combination of interlocking tuck stitches and float stitches, where the relative amounts of tuck stitches and float stitches may vary across different regions of the front portion 110.

For example, example aspects of the front portion 110 may include a first breast-contacting region 130 configured to substantially cover a right breast of a wearer and a second breast-contacting region 140 configured to substantially cover a left breast of a wearer when the bra 100 is in an as-worn configuration. A Y-shaped region 120 of the front portion 110 may be located between the first breast-contacting region 130 and the second breast-contacting region 140. The Y-shaped region 120 may include an upper right portion 122, an upper left portion 124, and a lower central portion 126. A right edge 123 extends between the upper right portion 122 and the lower central portion 126, and a left edge 125 extends between the upper left portion 124 and the lower central portion 126. As shown, the right edge 123 and the left edge 125 converge toward each other as they extend toward the lower central portion 126. The Y-shaped region 120 may also include an upper edge 127 that extends between the upper right portion 122 and the upper left portion 124. In example aspects, the upper edge 127 may be positioned a distance below the neckline edge 102 as depicted in FIGS. 1 and 2. For instance, the front portion 110 may include a neckline region 180 that separates the upper edge 127 of the Y-shaped region from the neckline edge 102. Alternatively, the upper edge 127 of the Y-shaped region may form the neckline edge 102.

The upper right portion 122 of the Y-shaped region 120 is positioned generally above the first breast-contacting region 130 and may extend into the right shoulder strap 190. The upper left portion 124 of the Y-shaped region 120 is positioned generally above the second breast-contacting region 140 and may extend into the left shoulder strap 190. The lower central portion 126 of the Y-shaped region 120 is located in a medial area of the front portion 110 such that it is positioned between the first breast-contacting region 130 and the second breast-contacting region 140. In example aspects, the lower central portion 126 extends down to the top chestband edge 174 of a front chestband region 170.

The front portion 110 of the bra 100 may further include a first wing region 150 configured to cover a right rib area of a wearer and a second wing region 160 configured to cover a left rib area of a wear when the bra 100 is in an as-worn configuration. The first wing region 150 is positioned laterally relative to the first breast-contacting region 130 and is separated from the lower central portion 126 of the Y-shaped region 120 by the first breast-contacting region 130. The second wing region 160 is positioned laterally relative to the second breast-contacting region 140 and is separated from the lower central portion 126 of the Y-shaped region 120 by the second breast-contacting region 140.

In example aspects, the Y-shaped region 120 has different stretch properties than the first breast-contacting region 130 and the second breast-contacting region 140. For instance, the Y-shaped region 120 may have a higher modulus of elasticity than the first breast-contacting region 130 and the second breast-contacting region 140. Due to its relatively higher modulus of elasticity, the Y-shaped region 120 may be able to provide support and control to a wearer's breasts. For example, the upper right portion 122 and the upper left portion 124 may help to limit upward movement of a wearer's breasts during movement such as during exercise. The lower central portion 126 of the Y-shaped region 120 may act as an anchor to stabilize the upper right portion 122 and the upper left portion 124. Additionally, in example aspects, the first wing region 150 and the second wing region 160 may also have a greater modulus of elasticity or a greater degree of stretch resistance relative to the first breast-contacting region 130 and the second breast-contacting region 140. The increased support provided by the greater modulus of elasticity of the first wing region 150 and the second wing region 160 may limit outward or lateral movement of the wearer's breasts.

The greater moduli of elasticity of the Y-shaped region 120, the first wing region 150 and the second wing region 160 may at least partly be due to greater tension applied to yarns during knitting of those regions, which results in shorter knit stitch lengths. In example aspects, for instance, the front courses and the back courses have shorter knit stitch length within the Y-shaped region 120, the first wing region 150, and the second wing region 160 compared to the front courses and the back courses within the first breast-contacting region 130 and the second breast-contacting region 140. In some aspects, the intermediate courses between the front courses and the back courses also have a shorter knit stitch length within the Y-shaped region 120, the first wing region 150, and the second wing region 160. In example aspects, the knit stitch length within the first wing region 150 is the same or substantially the same as the knit stitch length within the second wing region 160. In some aspects, the knit stitch length within the Y-shaped region 120 is also the same or substantially the same as the knit stitch lengths within the first wing region 150 and the second wing region. In other aspects, the knit stitch length within the Y-shaped region 120 is different than the knit stitch length within the first wing region 150 and the second wing region 160.

In example aspects, the regions within the front portion 110 may also vary in the ratio of float stitches to tuck stitches within the intermediate courses. In example aspects, the intermediate courses within the front portion 110 may have a greater ratio of float stitches to tuck stitches within the Y-shaped region 120 and, in some aspects, within the first wing region 150 and the second wing region 160 relative to the first breast-contacting region 130 and the second breast-contacting region 140. Example stitch sequences of float stitches and tuck stitches that may be used in the Y-shaped region, the first breast-contacting region 130, the second breast-contacting region 140, the first wing region 150, and the second wing region 160 are described further in connection to FIGS. 5-9.

A float stitch generally reduces stretch such that a region with a greater ratio of float stitches to tuck stitches may have a greater modulus of elasticity compared to regions with lower ratios. Further, different ratios of float stitches to tuck stitches may visually distinguish different integrally knit regions within the bra 100. For example, as described further with respect to FIGS. 5-9, tuck stitches within the intermediate course help to bind together a front layer and a back layer of a double-knit textile structure, where float stitches within the intermediate course may space apart the front layer and the back layer, thereby adding some dimension where the float stitches are present. Additionally, the yarn strand forming the intermediate courses is only visible to an outer-facing or inner-facing surface of the bra 100 at locations where the intermediate course forms a tuck stitch with the front course or back course respectively. In example aspects, the yarn strand forming the intermediate course is not visible when the yarn strand forms a float stitch that is positioned between the front courses and the back courses. Thus, in example aspects where the yarn strand forming the intermediate course has a different color than the yarn strand forming the front courses and back courses, varying the number of float stitches relative to the number of tuck stitches may also provide a visual distinction of different regions within the bra 100.

In addition to a stitch sequence with float stitches and tuck stitches as described above, the first wing region 150 and the second wing region 160 may also include one or more additional knit structures to provide additional support. For example, in some aspects, the first wing region 150 and the second wing region 160 may also include integrally knit rib structures. In one example, the first wing region 150 and the second wing region 160 each have a plurality of rib structures formed by a knit rib sequence, such as a 1×1 rib sequence. Rib structures generally provider greater elasticity in the course direction and decrease the tendency of a knit material to unravel or curl. As such, having rib stitches within the first wing region 150 and second wing region 160 may improve the fit of the bra 100 around the sides of a wearer's rib cage.

The first wing region 150 and the second wing region 160 may also include a mesh structure to increase breathability. In example aspects, the mesh structure includes openings that are created by transferring a knit loop onto another needle, such as an adjacent needle, during knitting. These integrally knit mesh openings permit air flow into the interior of the bra 100 to help cool off a wearer and allow for moisture and heat to escape out of the interior of the bra 100.

Additionally, as previously described, the front portion 110 in FIGS. 1 and 2 includes the front chestband region 170 forming a lower area of the front portion 110. In example aspects, the front chestband region 170 includes a right-side section 176 and a left-side section 178 that each have a plurality of rib structures, such as 1×1 rib structures. Similarly, the back chestband region 270 that forms a lower area of the back portion 210 of the bra 100 may also include a plurality of rib structures, such as 1×1 rib structures. The rib structures within the front chestband region 170 and the back chestband region 270 provide stability and a greater course-wise stretch, which can make the bra 100 easier for the wearer to don and doff.

The front chestband region 170 may also include a central section 175 that separates the right-side section 176 and the left-side section 178. The central section 175 of the front chestband region 170 may include a mesh structure created by transfer stitches that is similar to the mesh structure described with respect to the first wing region 150 and the second wing region 160. The mesh structure within the front chestband region 170 may increase breathability within the central section 175 of the front chestband region 170, which is an area in which moisture is often trapped.

In some aspects, the front portion 110 of the bra 100 also includes the neckline region 180 that has a knitted mesh structure with mesh openings created by transfer stitches. As depicted in FIGS. 1-2, the neckline region 180 is positioned above the lower central portion 126 of the Y-shaped region 120 and is positioned between at least part of the upper right portion 122 and the upper left portion 124 of the Y-shaped region 120. The integrally knit mesh openings may increase breathability to an upper central region of the wearer's chest, which tends to be a high heat producing region.

Referring to the back view of FIG. 3, example aspects of the back portion 210 may include additional integrally knit regions with different knit structures. For example, in addition to the back chestband region 270, the back portion 210 may include an upper back region 230 that forms an upper area of the back portion 210, including a posterior portion of the shoulder straps 190. Additionally, the back portion may include a central back region 220 that is configured to extend from the upper back region 230 to the top chestband edge 274 of the back chestband region 270.

In some aspects, the upper back region 230 has a greater modulus of elasticity relative to other regions within the back portion 210 due, at least in part, to greater tension during knitting, which results in shorter knit stitch lengths in the upper back region 230. In example aspects, for instance, at least the front courses and back courses within the upper back region 230 have a shorter knit stitch length relative to the respective front courses and back courses within the central back region 220. In some aspects, the knit stitch length within the upper back region 230 is the same or substantially the same as the knit stitch length within the Y-shaped region 120 of the front portion 110 of the bra 100. The shorter knit stitch lengths provide greater support to the upper back region 230, which may include at least part of the shoulder straps 190. In this way, the upper back region 230 may help to limit movement of the straps and, consequently, the wearer's breasts when the bra 100 is worn.

In example aspects, the central back region 220 of the back portion 210 includes an integrally knit mesh structure to provide breathability. The mesh structure of the central back region 220 may include openings that are created by transferring a knit loop onto another needle, such as an adjacent needle, during knitting. These integrally knit mesh openings permit air flow into the interior of the bra 100 at the wearer's back, which is a high heat-producing area. This increased airflow helps cool off a wearer and allows for moisture and heat to escape out of the interior of the bra 100.

To further promote ventilation, aspects of the central back region 220 may include larger openings 226, 227, and 228 that define outer edges of strap portions 222 and 224. In some aspects, the openings 226, 227, and 228 extend upward from the top chestband edge 274 of the back chestband region 270. Further, the openings 226, 227, and 228 may have a length that extends from about 30% to about 90% of the height of the central back region 220, from about 40% to about 80% of the height of the central back region 220, or from about 50% to about 75% of the height of the central back region 220. These openings 226, 227, and 228 may also allow for a greater range of movement when the wearer is wearing the bra 100 while providing ventilation.

Figure 4:
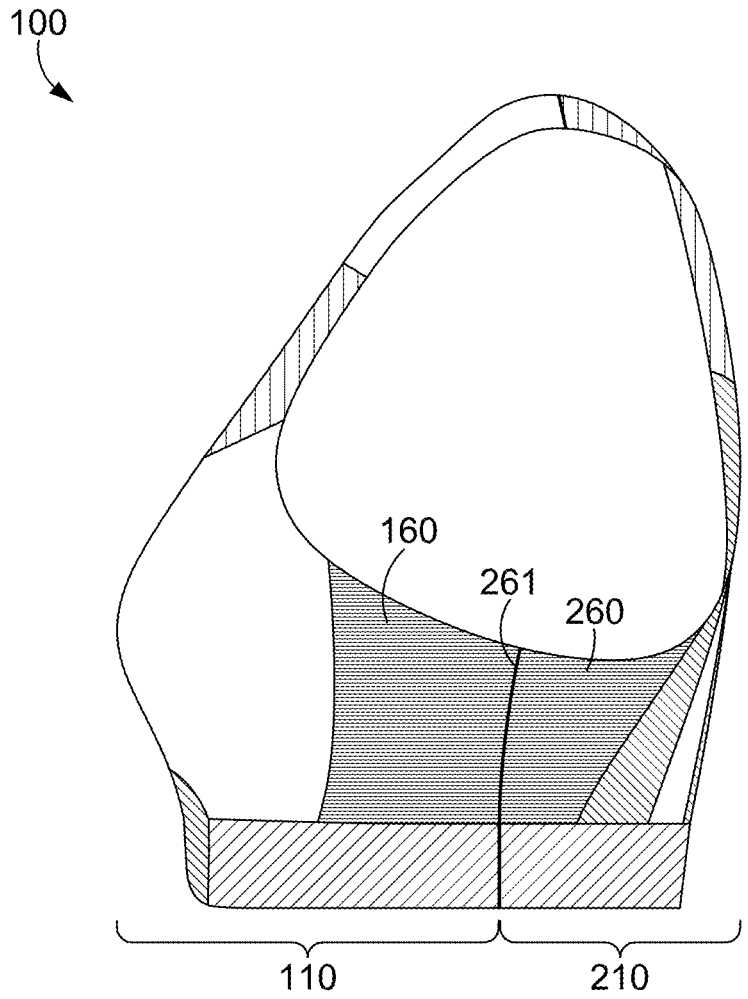
FIG. 4 illustrates a left-side view of the bra of FIG. 1 in accordance with aspects herein.

In some aspects, the back portion 210 of the bra 100 also includes a first back wing region 250 configured to cover a back right rib area of a wearer and a second back wing region 260 configured to cover a back left rib area of a wear when the bra 100 is in an as-worn configuration. The first back wing region 250 and the second back wing region 260 may each be positioned adjacent to and separated by the central back region 220. When the back portion 210 is joined with the front portion 110, the first back wing region 250 may be joined with the first wing region 150 on the front portion 110 to form a single wing region on the right side, while the second back wing region 260 may be joined with the second wing region 160 on the front portion 110 to form a single wing region on the left side. For example, a left-side view of the bra 100 is depicted in FIG. 4, where the second wing region 160 of the front portion 110 is joined with the second back wing region 260 of the back portion 210. The second front and back wing regions 160 and 260, respectively, may be joined by stitching or bonding to form a seam line 261. A right-side view of the bra 100 would be a mirror image of the left-side view. In example aspects, the first back wing region 250 and the second back wing region 260 have the same knit structure as described for the first wing region 150 and the second wing region 160 on the front portion 110.

As previously mentioned, in example aspects, the double-knit textile structure of the back portion 210 includes intermediate courses generally positioned between the front and back courses and that include a stitch sequence of either tuck stitches or a combination of tuck stitches and float stitches. The stitch sequence(s) of the intermediate courses of the back portion 210 may include any of the stitch sequences discussed with respect to the front portion 110, including sequences described below in connection to FIGS. 5-9. Additionally, the stitch sequence of intermediate courses within the double-knit textile structure of the back portion 210 may vary across at least some of the different regions of the back portion 210. In some aspects, the stitch sequences vary within single region of the back portion 210. Alternatively, the back portion 210 may have a uniform stitch sequence within the intermediate courses across different regions.

Figure 5:
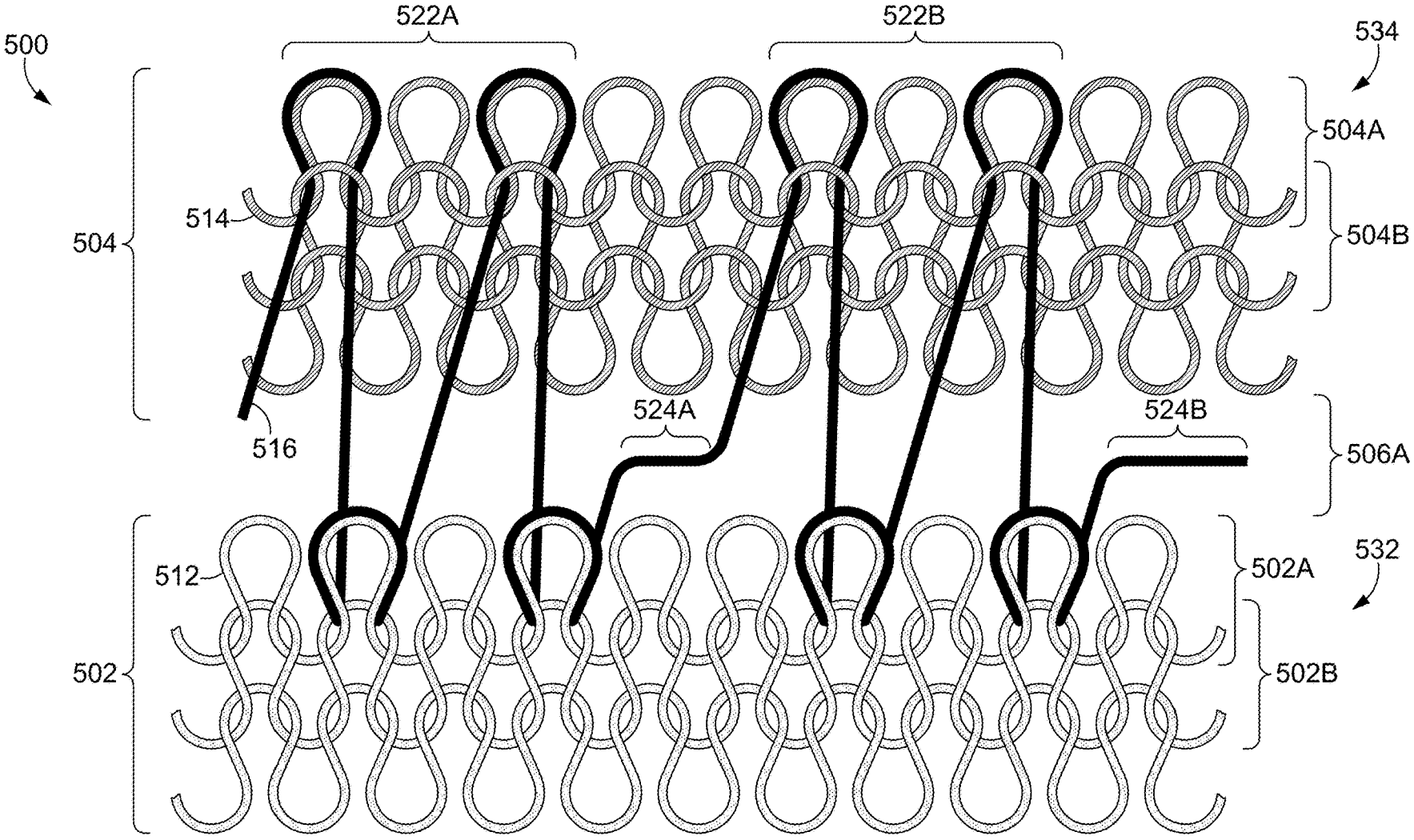
FIG. 5 illustrates a knit schematic of an example knit structure in one or more regions of the bra of FIG. 1 in accordance with aspects herein.

Turning to FIGS. 5-9, example stitch sequences of float and tuck stitches that may be utilized within one or more regions of the bra 100 are provided. FIG. 5, for instance, depicts a knit schematic with an example knit structure 500 that may be utilized within one or more regions of the bra 100. Specifically, the knit structure 500 is a double-knit textile structure that includes an intermediate course having tuck stitches and float stitches. The knit structure 500 of FIG. 5 may be utilized within the Y-shaped region 120. Additionally, in some aspects, the knit structure 500 may also be utilized within the first wing region 150 and the second wing region 160.

The knit structure 500 includes a plurality of front courses 502 constructed from a first yarn strand 512 and a plurality of back courses 504 constructed from a second yarn strand 514. The front courses 502 form a front layer 532 of the knit structure 500, and the back courses 504 form a back layer 534 of the knit structure 500. In some aspects, when the knit structure 500 is integrated into a garment, such as the bra 100, the front layer 532 may be an outer-facing layer, and the back layer 534 may be an inner-facing layer. In some aspects not shown, the front courses 502 intermittently interlock with the back courses 504 within the knit structure 500 by the first yarn strand 512 extending from a front course to a back course at the same stitch position that the second yarn strand 514 extends the back course to the front course. This switch of the first yarn strand 512 and the second yarn strand 514 between the front courses 502 and the back courses 504 is referred to as an interlocking cross over, which is described in greater detail in U.S. Pat. No. 10,145,042 to Diaz et al., which is incorporated herein by reference.

Additionally, the knit structure 500 includes intermediate courses formed by a third yarn strand 516 extending between the front courses 502 and the back courses 504. Within each intermediate course, the third yarn strand 516 interloops with a front course and a corresponding back course. For example, the third yarn strand 516 interloops with the front course 502A and the back course 504A to form an intermediate course 506A. To avoid overcrowding the illustrative knit structure 500 in FIG. 5, other intermediate courses are not depicted (e.g., in the course formed by the front course 502B and the back course 504B), but it should be understood that the knit structure 500 may include successive intermediate courses, such as the intermediate course 506A between the front course 502A and the back course 504A (depicted) and a second intermediate course between the front course 502B and the back course 504B (not depicted).

The intermediate course 506A includes a combination of tuck stitches and float stitches. A tuck stitch is formed when the third yarn strand 516 interloops with either a front course (e.g., front course 502A) or a back course (e.g., back course 504A). For example, the intermediate course 506A includes tuck stitches 522A, which includes interlooping with every other front stitch in the front course 502A and every other back stitch in the back course 504A to form a total of four tuck stitches. The third yarn strand 516 alternates between interlooping with the front course 502A and the back course 504A, and the tuck stitches 522A may be referred to herein as interlocking tuck stitches as the tuck stitches 522A function to bind the front course 502A and the corresponding back course 504A.

The intermediate course 506A further includes float stitches in which the third yarn strand 516 is floated between the front course 502A and the back course 504A. Specifically, after the four tuck stitches 522A, intermediate course 506A includes a float stitch 524A that spans two stitch positions (e.g., floats between two stitches in the front course 502A and two stitches in the back course 504A). Because a float stitch is created by missing one or more needles during knitting, float stitch 524A may be referred to as a two-needle float stitch or a two-needle miss stitch. Whereas the interlocking tuck stitches 522A of the third yarn strand 516 keeps the front layer 532 and the back layer 534 bound together, the float stitch 524A partially separates the front layer 532 and the back layer 534. Additionally, the float stitch 524A may increase the modulus of elasticity of the knit structure 500.

In example aspects, the knit structure 500 may follow a repeated sequence of tuck stitches and float stitches along one or more intermediate courses. For example, the intermediate course 506A includes the first set of four tuck stitches 522A and the first two-needle float stitch 524A. This sequence may repeat such that, immediately after the first two-needle float stitch 524A, the intermediate course 506A includes a second set of four tuck stitches 522B and a second two-needle float stitch 524B, and this pattern may repeat an additional number of times.

As mentioned, additional courses within the knit structure 500 may include the third yarn strand 516 forming tuck stitches or a combination of tuck stitches and float stitches. In example aspects, the sequence of subsequent intermediate courses may be the same as intermediate course 506A. Alternatively, the sequence may be different such that there may be a different number of tuck stitches, a different number of float stitches, a different number of stitch positions within the float stitches, different stitch positions for the tuck stitches, or different stitch positions for the float stitches. Additionally, in example aspects, adjacent intermediate courses may alternate whether a sequence of tuck stitches starts on the front bed or the back bed such that a front tuck stitch in one intermediate course is in the same stitch position as a back tuck stitch in an adjacent intermediate course.

Referring to the third yarn strand 516, the knit structure 500 has a ratio of float stitches to tuck stitches of 1:2 (e.g., 4 total float stitches and 8 total tuck stitches). In determining this ratio, the float stitches may be the number of stitch positions over which the third yarn strand 516 is floated. In other words, while there are two float stitches (e.g., 524A and 524B in FIG. 5), each float stitch is a two-needle float stitch in that each extends over two stitch positions. As discussed further with respect to FIGS. 8-9, different ratios of float stitches to tuck stitches may be utilized within other regions of a bra, such as bra 100.

Figure 6:
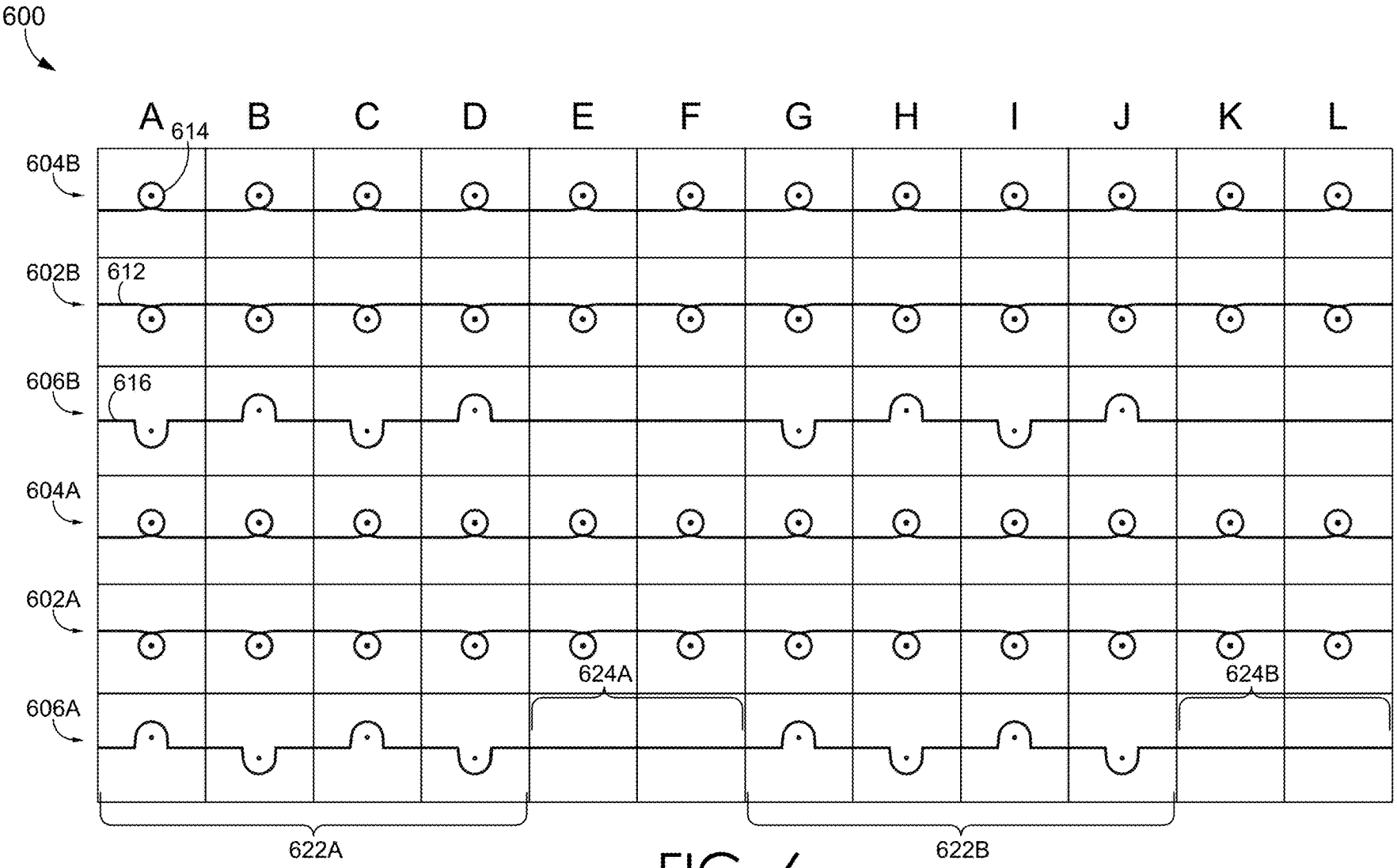
FIG. 6 illustrates a knit diagram for the example knit structure of FIG. 5 in accordance with aspects herein.

Referring now to FIG. 6, an example knit diagram 600 is depicted corresponding with the knit structure 500 of FIG. 5. The knit diagram 600 may represent knit structures within one or more regions of the bra 100 of FIGS. 1-4, such as the Y-shaped region 120 and, in some aspects, the first wing region 150 and the second wing region 160.

The knit diagram 600 designates a stitch type for rows 602A, 604A, 606A, 602B, 604B, and 606B at 12 stitch positions (which may also be referred to as stitch locations) represented by columns A-L. Each of rows 602A and 602B prescribe knit structures for a first yarn strand 612, and each of rows 604A and 604B prescribe knit structures for a second yarn strand 614. Additionally, each of rows 606A and 606B prescribe knit structures for a third yarn strand 616. Within each row, the stitch type is designated with an indication of whether the stitch is on the front bed or the back bed. A stitch notation beneath the yarn strand is on the front bed, and a stitch notation above the yarn strand is on the back bed. As such, rows 602A and 602B indicate that the first yarn strand 612 is on the front bed for stitch positions A-L, and rows 604A and 604B indicate that the second yarn strand 614 is on the back bed for stitch positions A-L. As such, rows 602A and 602B may correspond to front courses, such as the front courses 502 in FIG. 5, while rows 604A and 604B may correspond to back courses, such as the back courses 504 in FIG. 5. Rows 606A and 606B indicate that the third yarn strand 616 alternates tuck stitches on the front bed and the back bed for a set of stitch positions and then floats between the front bed and the back bed for a set of stitch positions. As such, rows 606A and 606B may correspond to intermediate courses similar to the intermediate course 506A in FIG. 5. In example aspects, rows 602A, 604A, and 606A would be knit substantially at the same time, and rows 602B, 604B, and 606B would be knit substantially at the same time.

Row 606A of the knit diagram 600 includes a first set of four tuck stitches 622A (corresponding to stitch positions A-D), a first two-needle float stitch 624A (corresponding to stitch positions E-F), a second set of four tuck stitches 622B (corresponding to stitch positions G-J), and a second two-needle float stitch 624B (corresponding to stitch positions K-L). In this way, the third yarn strand 616 follows the same sequence in row 606A as the third yarn strand 516 in the intermediate course 506A in FIG. 5. Similarly, this sequence results a 1:2 ratio of float stitches to tuck stitches.

The third yarn strand 616 generally follows the same sequence in row 606B as in row 606A. However, the tuck stitches in row 606B are formed on the opposite bed as the tuck stitches in the corresponding stitch positions within row 606A. For example, similar to row 606A, row 606B includes a set of four tuck stitches corresponding to stitch positions A-D, but row 606B has back tuck stitches corresponding to stitch positions A and C while row 606A has front tuck stitches corresponding to stitch positions A and C.

Figure 7:
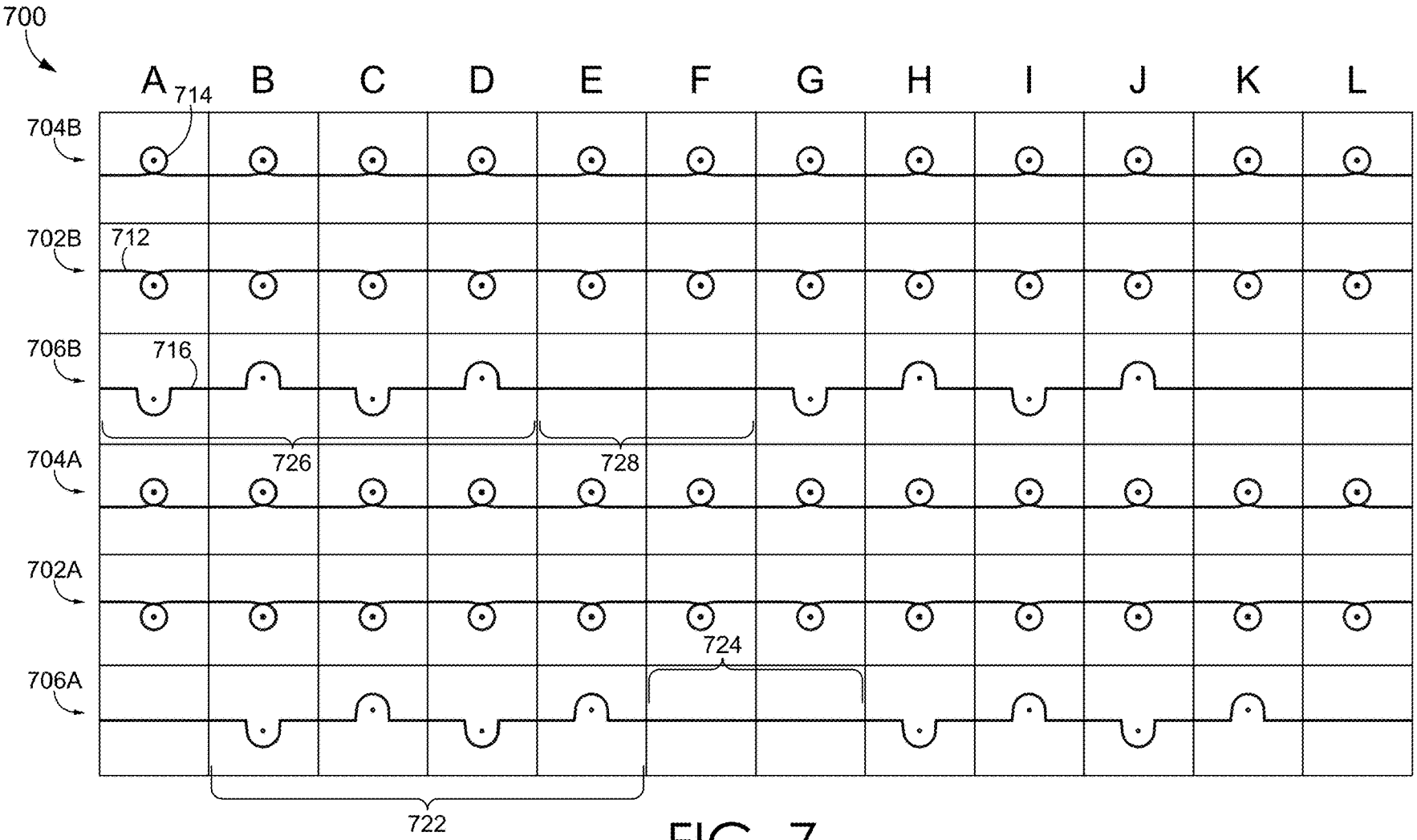
FIG. 7 illustrates a knit diagram for the example knit structure of FIG. 5 in accordance with aspects herein.

FIG. 7 depicts an alternative example knit diagram 700 that may correspond with the knit structure 500 of FIG. 5. The knit diagram 700 may represent knit structures within one or more regions of the bra 100 of FIGS. 1-4, such as the Y-shaped region 120 and, in some aspects, the first wing region 150 and the second wing region 160.

Similar to the knit diagram 600 of FIG. 6, the knit diagram 700 designates a stitch type for rows 702A, 704A, 706A, 702B, 704B, and 706B at 12 stitch positions represented by columns A-L. Each of rows 702A and 702B prescribe knit structures for a first yarn strand 712, and each of rows 704A and 704B prescribe knit structures for a second yarn strand 714. Additionally, each of rows 706A and 706B prescribe knit structures for a third yarn strand 716. Rows 702A and 702B indicate that the first yarn strand 712 is on the front bed for stitch positions A-L, and rows 704A and 704B indicate that the second yarn strand 714 is on the back bed for stitch positions A-L. As such, rows 702A and 702B may correspond to front courses, such as the front courses 502 in FIG. 5, while rows 704A and 704B may correspond to back courses, such as the back courses 504 in FIG. 5. Rows 706A and 706B indicate that the third yarn strand 716 alternates tuck stitches between the front and back beds for a set of stitch positions and then floats between the front bed and the back bed for a set of stitch positions. As such, rows 706A and 706B may correspond to intermediate courses similar to the intermediate course 506A in FIG. 5. In example aspects, rows 702A, 704A, and 706A would be knit substantially at the same time, and rows 702B, 704B, and 706B would be knit substantially at the same time.

Rows 706A and 706B include the same 1:2 ratio of float stitches to tuck stitches as rows 606A and 606B in FIG. 6. Additionally, similar to rows 606A and 606B, rows 706A and 706B follow a stitch sequence of four tuck stitches (e.g., 722 and 726) and a two-needle float stitch (e.g., 724 and 728). However, unlike the knit diagram 600 of FIG. 6, these stitch positions of these structures are different in rows 706A and 706B. For instance, row 706A includes the set of four tuck stitches 722 in stitch positions B-E and the two-needle float stitch 724 in stitch positions F and G, whereas row 706B includes the set of four tuck stitches 726 in stitch positions A-D and the two-needle float stitch 728 in stitch positions E and F. In this way, the tuck-float stitch sequence of adjacent intermediate rows 706A and 706B are offset by one stitch position. In other example aspects, the tuck-float sequence of adjacent intermediate rows 706A and 706B may be offset by a greater number of stitch positions. For example, in some aspects, the offset of the stitch sequence in adjacent courses is between 2 and 10 stitch positions, between 3 and 8 stitch positions, or between 4 and 6 stitch positions.

Figure 8:
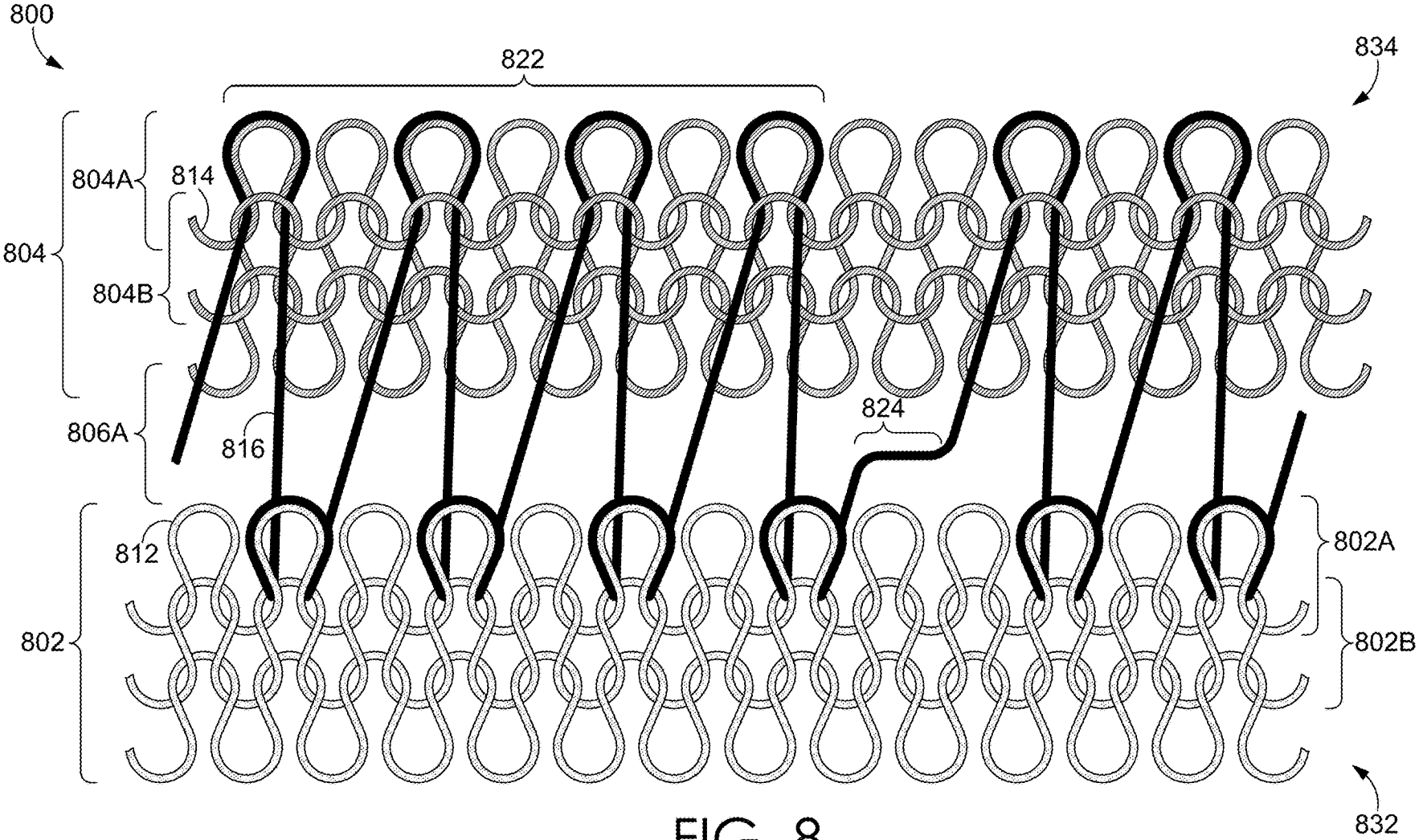
FIG. 8 illustrates a knit schematic of an example knit structure in one or more regions of the bra of FIG. 1 in accordance with aspects herein.

Turning to FIG. 8, a knit schematic is depicted and illustrates an example knit structure 800 that may be utilized within one or more regions of the bra 100. Specifically, the knit structure 800 is a double-knit textile structure that includes an intermediate course having tuck stitches and float stitches. The knit structure 800 of FIG. 8 may be utilized within, for example, the first breast-contacting region 130 and the second breast-contacting region 140 of bra 100.

The knit structure 800 may be similar to the knit structure 500 of FIG. 5 in that the knit structure 800 may include a plurality of front courses 802 constructed from a first yarn strand 812 and a plurality of back courses 804 constructed from a second yarn strand 814. The front courses 802 form a front layer 832 of the knit structure 800, and the back courses 804 form a back layer 834 of the knit structure 800. In example aspects, when the knit structure 800 is integrated into a garment, such as the bra 100, the front layer 832 is an outer-facing layer and the back layer 834 is an inner-facing layer. In some example aspects, the front courses 802 may intermittently interlock with the back courses 804 within the knit structure 800 through interlocking cross overs as described with respect to knit structure 500 of FIG. 5.

Additionally, the knit structure 800 may include one or more intermediate courses in which a third yarn strand 816 extends between a front course and a corresponding back course. For example, the third yarn strand 816 interloops with the front course 802A and the back course 804A to form an intermediate course 806A. To avoid overcrowding the illustrative knit structure 800 in FIG. 8, other intermediate courses are not depicted, but it should be understood that knit structure 800 may include additional intermediate courses, including an intermediate course between front course 802B and back course 804B for example.

Similar to the knit structure 500, intermediate courses of the knit structure 800 may include a combination of tuck stitches and float stitches. For example, the intermediate course 806A includes tuck stitches 822, which includes interlooping with every other front stitch in the front course 802A and every other back stitch in the back course 804A to form a total of eight tuck stitches. The third yarn strand 816 alternates between interlooping with the front course 802A and the back course 804A, and the tuck stitches 822 may be referred to herein as interlocking tuck stitches as the tuck stitches function to bind the front course 802A and the corresponding back course 804A.

The intermediate course 806A further includes float stitches in which the third yarn strand 816 is floated between the front course 802A and the back course 804A. Specifically, after the eight tuck stitches 822, the intermediate course 806A includes float stitch 824 that spans two stitch positions (e.g., floats between two stitches in the front course 802A and two stitches in the back course 804A). While the interlocking tuck stitches 822 of the third yarn strand 816 keep the front layer 832 and the back layer 834 bound together, the float stitch 824 may at least partially separate the front layer 832 and the back layer 834. Additionally, the float stitch 824 may increase the modulus of elasticity of the knit structure 800 relative to a knit structure without a float stitch.

In example aspects, intermediate courses within knit structure 800 may follow a repeated sequence of tuck stitches and float stitches. For example, the intermediate course 806A includes a first set of eight tuck stitches 822 and a first two-needle float stitch 824. This sequence may repeated such that immediately after the first two-needle float stitch 824, the intermediate course 806A may include a second set of eight tuck stitches, which may be followed by a second two-needle float stitch and so on beyond the limits of the depiction in FIG. 8. This sequence may be repeated across the same stitch positions within other intermediate courses. Alternatively, the sequence may be different such that there may be a different number of tuck stitches, a different number of float stitches, a different number of stitch positions over which the float stitches extend, different stitch positions for the tuck stitches, or different stitch positions for the float stitches. Additionally, in example aspects, adjacent intermediate courses may alternate whether a sequence of tuck stitches starts on the front bed or the back bed such that a front tuck stitch in one intermediate course is in the same stitch position as a back tuck stitch in an adjacent intermediate course.

Just as the intermediate course 806A has a different stitch sequence than the intermediate course 506A in FIG. 5, the knit structure 800 has a different ratio of float stitches to tuck stitches than the knit structure 500 of FIG. 5. For example, the knit structure 800 has a 1:4 ratio of float stitches to tuck stitches, which is a smaller ratio than the 1:2 ratio depicted in the knit structure 500.

In example aspects, a smaller ratio of float stitches to tuck stitches within the knit structure 800 results in a lower modulus of elasticity compared to the knit structure 500. As such, the Y-shaped region 120 and, in some aspects, the first wing region 150 and the second wing region 160 of FIGS. 1-2 may provide a greater degree of support through the knit structure 500 compared to the first breast-contacting region 130 and the second breast-contacting region 140 with the knit structure 800.

Alternatively or additionally, the different ratios of float stitches to tuck stitches within the knit structure 800 and the knit structure 500 may visually distinguish different functional regions within a bra, such as bra 100. For example, as previously stated, interlocking tuck stitches within the intermediate course help to bind together a front layer and a back layer, where float stitches within the intermediate course may partially space apart the front layer and the back layer, thereby adding some dimension where the float stitches are present. Regions with higher ratios of float stitches to tuck stitches, such as the Y-shaped region 120, the first wing region 150, and the second wing region 160, may have more dimensionality (i.e., a greater thickness) than regions with a lower ratio, such as the first breast-contacting region 130 and the second breast-contacting region 140.

Additionally, in some aspects, a different yarn color for the third yarn strand forming intermediate courses provides a visual distinction of zones with different ratios of float stitches to tuck stitches. For example, the third yarn strand may be a different color than the first yarn strand and the second yarn strand. In some aspects, each yarn strand is a different color. Where the third yarn strand forms interlocking tuck stitches with the front courses and the back courses, the color of the third yarn strand may be visible from the front layer and the back layer, respectively, and where the third yarn strand floats between the front courses and the back courses, the color of the third yarn strand may be absent from the front layer and the back layer. In this way, areas with a greater ratio of float stitches to tuck stitches, such as the Y-shaped region 120, the first wing region 150, and the second wing region 160, may have a lower density of the color of the third yarn strand than regions with a lower ratio, such as the first breast-contacting region 130 and the second breast-contacting region 140.

Figure 9:
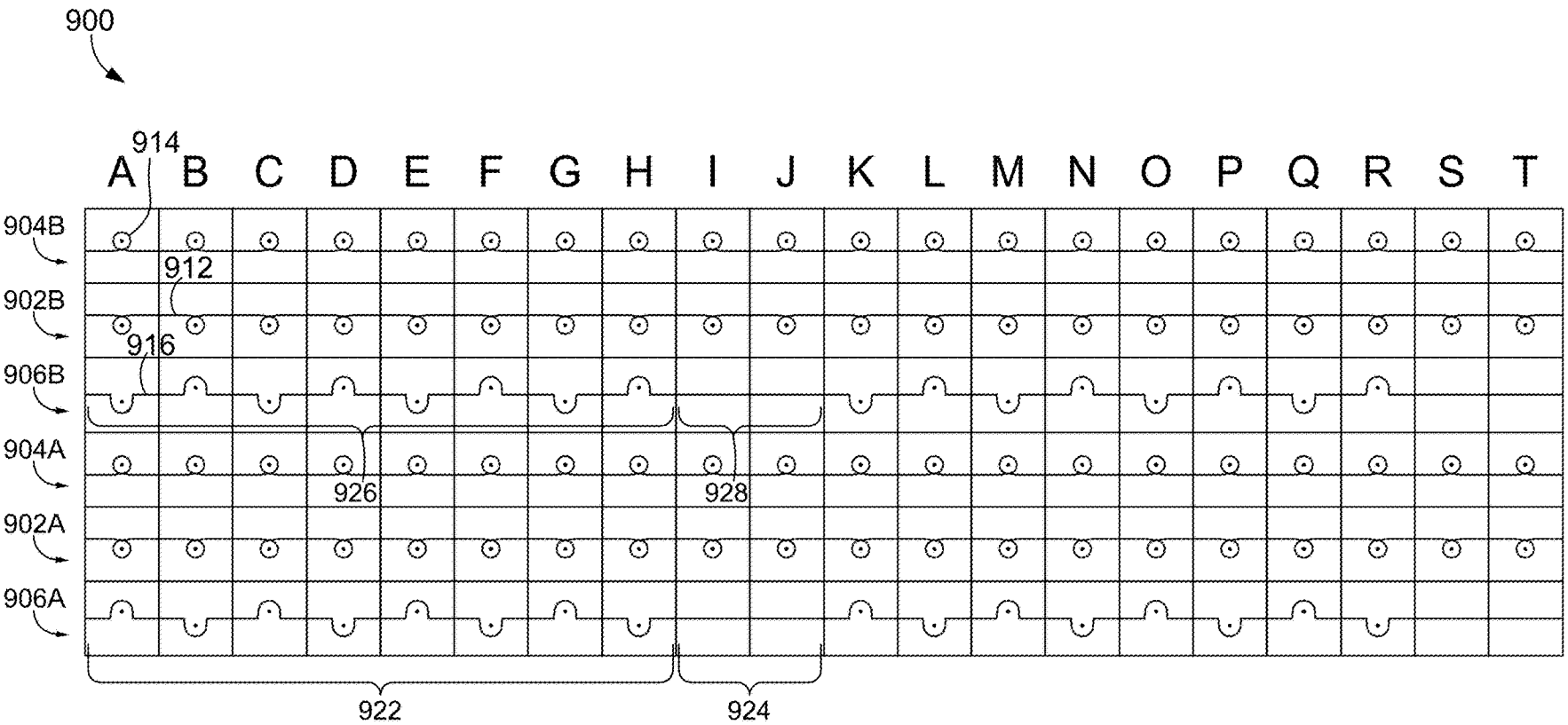
FIG. 9 illustrates a knit diagram for the example knit structure of FIG. 8 in accordance with aspects herein.

Referring now to FIG. 9, an example knit diagram 900 is depicted corresponding with the knit structure 800 of FIG. 8. The knit diagram 900 may represent knit structures within one or more regions of the bra 100 of FIGS. 1-4, such as the first breast-contacting region 130 and the second breast-contacting region 140.

The knit diagram 900 designates a stitch type for rows 902A, 904A, 906A, 902B, 904B, and 906B at 20 stitch positions represented by columns A-T. Each of rows 902A and 902B prescribe knit structures for a first yarn strand 912, and each of rows 904A and 904B prescribe knit structures for a second yarn strand 914. Additionally, each of rows 906A and 906B prescribe knit structures for a third yarn strand 916. Rows 902A and 902B indicate that the first yarn strand 912 is on the front bed for stitch positions A-T, and rows 904A and 904B indicate that the second yarn strand 914 is on the back bed for stitch positions A-T. As such, rows 902A and 902B may correspond to front courses, such as front courses 802 in FIG. 8, while rows 904A and 904B may correspond to back courses, such as back courses 804 in FIG. 8. Rows 906A and 906B indicate that the third yarn strand 916 alternates tuck stitches between the front bed and the back bed for a set of stitch positions and then floats between the front bed and the back bed for a set of stitch positions. As such, rows 906A and 906B may correspond to intermediate courses similar to the intermediate course 806A in FIG. 8. In example aspects, rows 902A, 904A, and 906A would be knit substantially at the same time, and rows 902B, 904B, and 906B would be knit substantially at the same time.

Row 906A of the knit diagram 900 includes a first set of eight tuck stitches 922 and a first two-needle float stitch 924, and row 906B includes a first set of eight tuck stitches 926 and a first two-needle float stitch 928. This sequence repeats at least one more time in both row 906A and row 906B. As such, the third yarn strand 916 follows the same sequence as the third yarn strand 816 in FIG. 8. Similarly, this sequence may result in a 1:4 ratio of float stitches to tuck stitches. Additionally, similar to the knit diagram 600 of FIG. 6, the interlocking tuck stitches in rows 906A and 906B (which correspond to adjacent intermediate courses) may be formed on opposite beds in corresponding stitch positions. Further, in some aspects, the position of the stitch sequence in rows 906A and 906B may be offset in a similar manner as described with respect to knit diagram 700 of FIG. 7.

Figure 10:
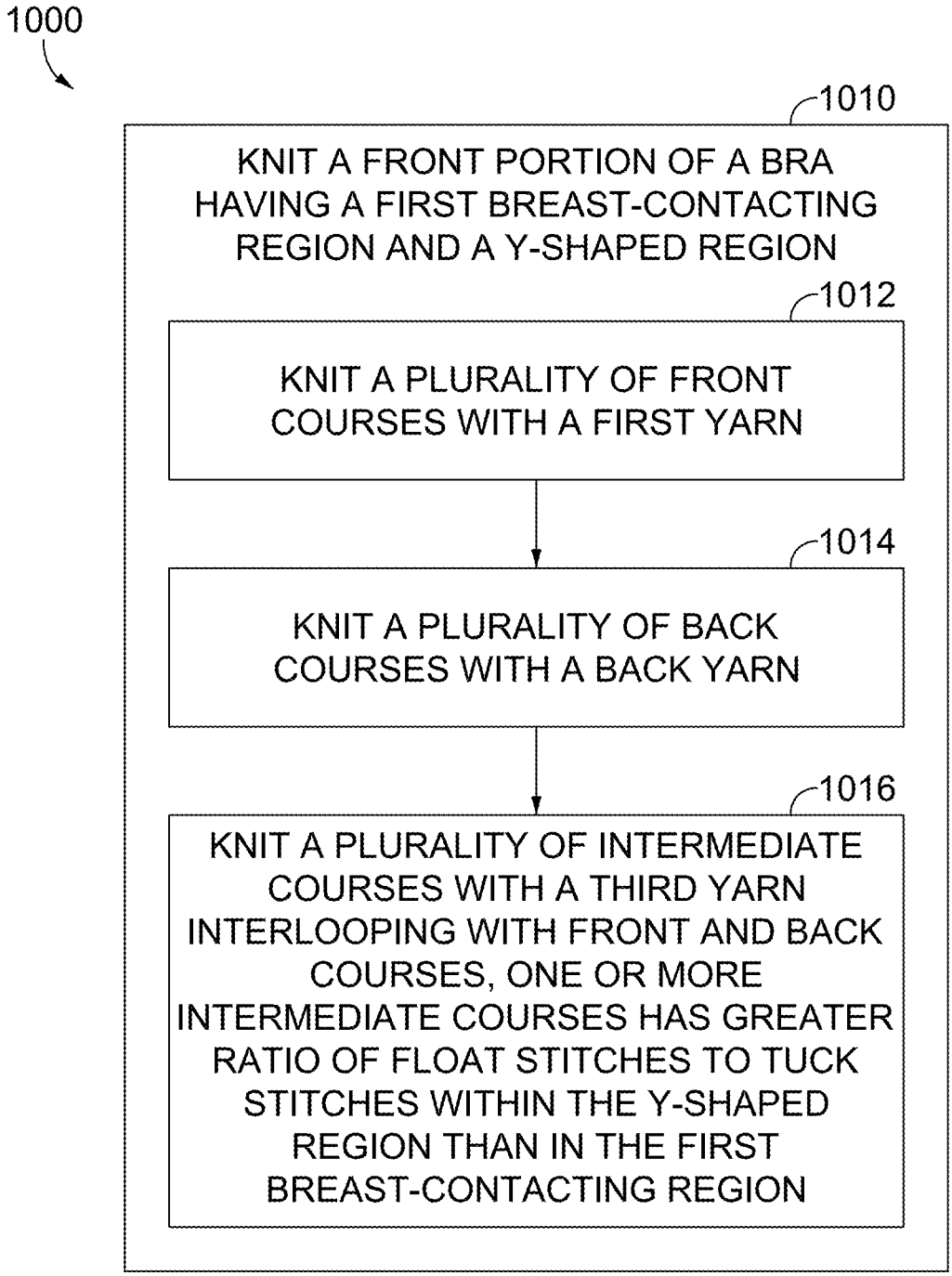
FIG. 10 illustrates a flow diagram of an example method of manufacturing a knit bra having different ratios of float stitches to tuck stitches in accordance with aspects herein.

FIG. 10 depicts a flow diagram of an example method 1000 of manufacturing a bra, such as the bra 100. At step 1010, the method 1000 includes knitting a front portion of the bra, such as the front portion 110. In example aspects, the front portion of the bra is formed by a weft-knitting process. The front portion includes a first breast-contacting region, such as first breast-contacting region 130, and a Y-shaped region, such as the Y-shaped region 120. The Y-shaped region may have an upper right portion, an upper left portion, and a lower central portion. Knitting the front portion includes, at step 1012, knitting a plurality of front courses with a first yarn on a front bed, and at step 1014, knitting plurality of back courses with a second yarn on a back bed.

At step 1016, a plurality of intermediate courses is knitted with a third yarn interlooping with the plurality of front courses and the plurality of back courses. One or more intermediate courses of the plurality of intermediate courses are knitted with one or more tuck stitches on either the front bed or the back bed and one or more float stitches arranged between the front courses and the back courses. The tuck stitches within an intermediate course may alternate between the front bed and the back bed. The intermediate courses have a greater ratio of float stitches to tuck stitches within the Y-shaped region than in the first breast-contacting region. For example, the one or more intermediate courses has a first ratio of float stitches to tuck stitches within the Y-shaped region and a second ratio of float stitches to tuck stitches within the first breast-contacting region, where the first ratio is greater than the second ratio.

In example aspects, the front portion of the bra further includes a second breast-contacting region, such as second breast-contacting region 140, that is separated from the first breast-contacting region by the Y-shaped region. As such, when forming the one or more intermediate courses within the front portion, the intermediate courses has a third ratio of float stitches to tuck stitches within the second breast-contacting region where the third ratio is less than the first ratio of the Y-shaped region. In some aspects, the third ratio within the second breast-contacting region is the same or substantially the same as the second ratio within the first breast-contacting region.

In some aspects, the front portion further includes a first wing region, such as first wing region 150, positioned adjacent the first breast-contacting region and a second wing region, such as second wing region 160, positioned adjacent the second breast-contacting region. The one or more intermediate courses may have a fourth ratio of float stitches to tuck stitches within the first wing region and a fifth ratio of float stitches to tuck stitches within the second wing region. The fourth ratio and the fifth ratio within the first wing region and the second wing region, respectively, are greater than the second ratio and the third ratio of the first breast-contacting region and the second breast-contacting region, respectively.

Some aspects of method 1000 further includes knitting a back portion of the bra, such as the back portion 210. The back portion may be knitted in a weft-knitting process. Further, in some aspects, the back portion is knitted by knitting a plurality of a plurality of front courses with a first yarn on a front bed and knitting plurality of back courses with a second yarn on a back bed. Further, in some aspects, knitting the back portion includes knitting a plurality of intermediate courses with a third yarn interlooping with the plurality of front courses and the plurality of back courses within the back portion. In some aspects, one or more intermediate courses of the plurality of intermediate courses include one or more tuck stitches on either the front bed or the back bed and one or more float stitches arranged between the front courses and the back courses.

Method 1000 may further include affixing the front portion and the back portion. Affixing the front portion to the back portion may include affixing a first front lateral edge (e.g., 116) to a first back lateral edge (e.g., 216) and affixing a second front lateral edge (e.g., 118) to a second back lateral edge (218). Affixing the front portion and the back portion may further include affixing a first front strap portion to a first back strap portion and affixing a second front strap portion to a second back strap portion to create a neck hole for the bra. It is contemplated that method 1000 may include affixing technologies such as stitching, bonding, welding, and the like.

In accordance with example aspects of this disclosure, a bra, such as the bra 100, is knitted such that the front portion and the back portion are knitted in different directions. In example aspects, both the front portion and the back portion are knitted in a weft-knitting process forming a plurality of loops arranged in courses and wales. Further, the knitting direction of the front portion may be orthogonal to the knitting direction of the back portion such that, when the front portion and the back portion are joined, courses within the front portion extend in a direction perpendicular to a direction of the courses within the back portion.

Additionally, aspects of method 1000 may further include knitting the front portion and the back portion to create flat knit edges that are free from surrounding material when the front portion and the back portion are knitted. In this way, the edges of the front portion and the back portion may be finished (e.g. without fraying or unraveling) without additional post-knitting finishing processes.

Figure 11:
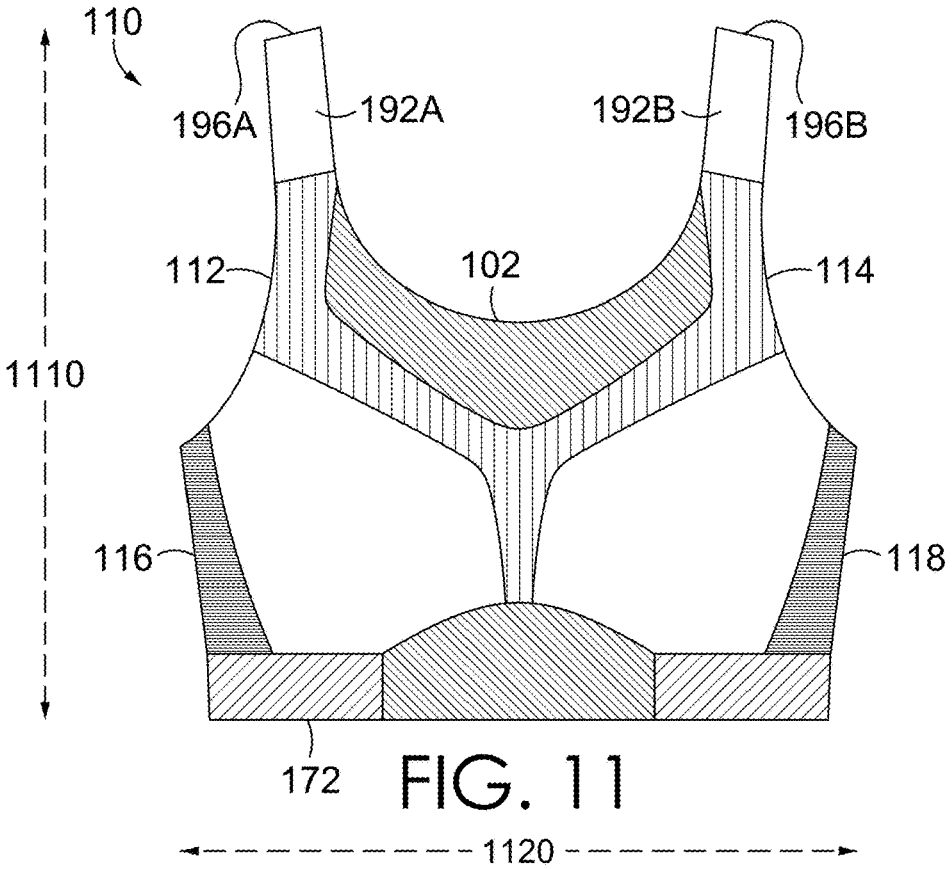
FIG. 11 illustrates a front portion of the bra of FIG. 1 in accordance with aspects herein.
Figure 12:
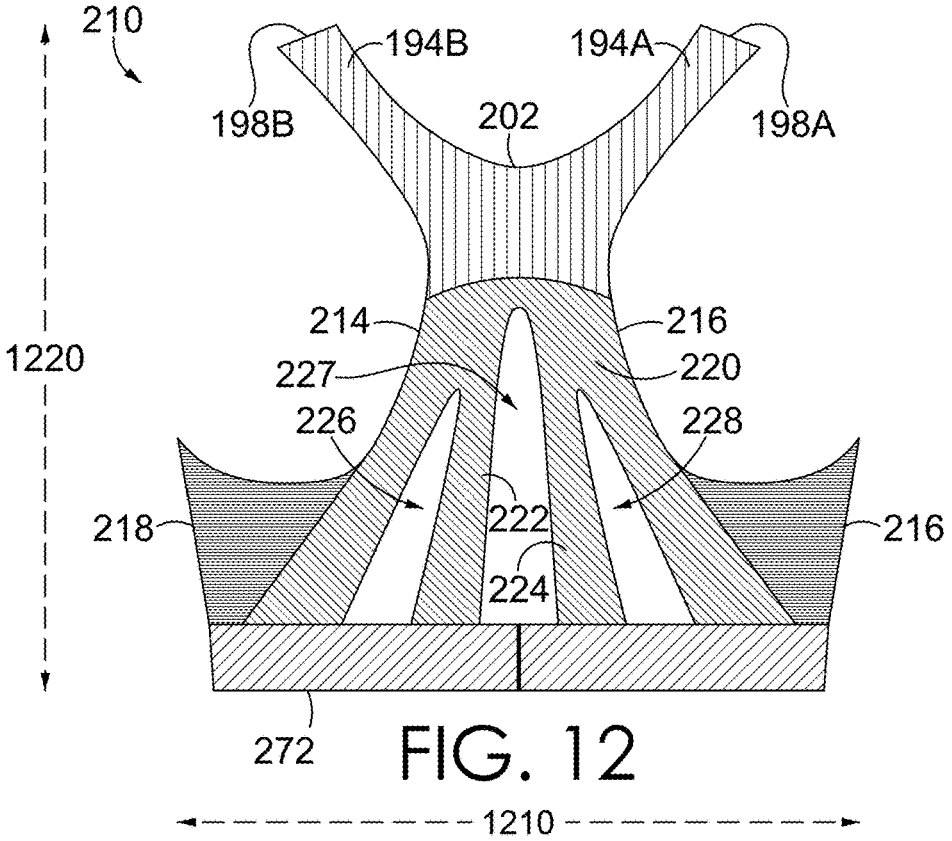
FIG. 12 illustrates a back portion of the bra of FIG. 1 in accordance with aspects herein.

For example, FIGS. 11 and 12 depict the front portion 110 and the back portion 210, respectively. The front portion 110 and the back portion 210 may have the same characteristics described with respect to FIGS. 1-10. The front portion 110 may include a first front strap portion 192A having a front strap superior edge 196A and a second front strap portion 192B having a front strap superior edge 196B. The front portion 110 may also include the neckline edge 102 between the front strap superior edges 196A and 196B. In example aspects, the front portion 110 extends from the front strap superior edges 196A and 196B and the neckline edge 102 to the bottom chestband edge 172 that forms a lower margin of the front portion 110. Additionally, the front portion 110 may extend from the first front lateral edge 116 to the second front lateral edge 118.

Similarly, the back portion 210 may include a first back strap portion 194A having a back strap superior edge 198A and a second back strap portion 194B having a back strap superior edge 198B. Additionally, the back portion 210 may also include the neckline edge 202 between the back strap superior edges 198A and 198B. In example aspects, the back portion 210 extends from the back strap superior edges 198A and 198A and the neckline edge 202 to the bottom chestband edge 272 that forms a lower margin of the back portion 210. Additionally, the back portion 210 may extend from the first back lateral edge 216 to the second back lateral edge 218.

In example aspects, the front portion 110 is knitted in a direction indicated by the front knitting direction arrow 1110, which extends along the height of the front portion 110 from the front strap superior edges 196A and 196B to the bottom chestband edge 172. As such, in example aspects, knitting of the front portion 110 may begin with knitting the bottom chestband edge 272 and end with knitting the front strap superior edges 196A and 196B or vice versa. Further, the knit courses forming the front portion 110 may extend as indicated by the front course direction arrow 1120, which is across the width of the front portion 110. In order words, the knit courses within the front portion 110 may extend in a horizontal direction when a bra, such as the bra 100, having the front portion 110 is in an as-worn configuration. Stated differently, the front course direction arrow 1120 may extend between the first armhole edge 112 and the second armhole edge 114.

Additionally, in example aspects, the back portion 210 is knitted in a direction indicated by the back knitting direction arrow 1210, which extends along the width of the back portion 210 from the first back lateral edge 216 to the second back lateral edge 218. As such, in example aspects, knitting the back portion 210 may begin with knitting the first back lateral edge 216 and end with knitting the second back lateral edge 218 or vice versa. Further, the knit courses forming the back portion 210 may extend as indicated by the back course direction arrow 1220, which is across the height of the back portion 210. In order words, the knit courses within the back portion 210 may extend in a vertical direction when a bra, such as the bra 100, having the back portion 210 is in an as-worn configuration. Stated differently, the back course direction arrow 1220 may extend between the neckline edge 202 and the bottom chestband edge 272. When the front portion 110 and the back portion 210 are joined, the knit courses within the front portion 110 extend perpendicular to the knit courses within the back portion 210.

Knitting the front portion 110 and the back portion 210 in different directions may facilitate creating different structures for the front portion 110 and the back portion 210. For instance, knitting the front portion 110 such that the courses extend horizontally across the width of the front portion 110 may provide more stretch in the horizontal direction to provide flexibility when the bra 100 is being donned or doffed and more vertical stability to provide support to the wearer's breasts.

Knitting the back portion 210 in the opposite direction increases efficiencies when creating openings. For example, as discussed with respect to FIG. 3, example aspects of the back portion 210 include the openings 226, 227, and 228 that are generally vertically extending in that the height of each opening is greater than the respective width. The openings 226, 227, and 228 delineate edges of strap portions as the strap portion 222 is formed between the openings 226 and 227 and the strap portion 224 is formed between the openings 227 and 228. The openings 226, 227, and 228 (as well as the resulting strap portions 222 and 224) are arranged side-by-side along a horizontal midline of the back portion 210. In this way, if the back portion 210 were knitted in a vertical direction such as the direction the front portion 110 is knit, a single course within the back portion 210 may intersect with each of the openings 226, and 227, and 228, which would require multiple instances of binding off within each course forming the strap portions 222 and 224. On the other hand, when the back portion 210 is knitted in a horizontal direction, as indicated in FIG. 12, less binding off is required as courses are formed in a vertical direction that correspond to the generally vertical direction in which the strap portions 222 and 224 extend.

Further, in some aspects, the strap portions 222 and 224 may be knit with different yarns than the rest of the back portion 210, and/or the strap portion 222 may be knit with different yarns than the strap portion 224. The different yarns may provide different visual properties, such as different colors or different textures, or may provide other structural changes, such as weight, moisture wicking properties, and stretch properties. As such, when the strap portions 222 and 224 are knitted with different yarns, knitting the back portion 210 in a horizontal direction is more efficient than knitting in a vertical direction, which would require multiple knitting machine carriers to change yarns across a course when knitting the strap portions 222 and 224.

Figure 13:
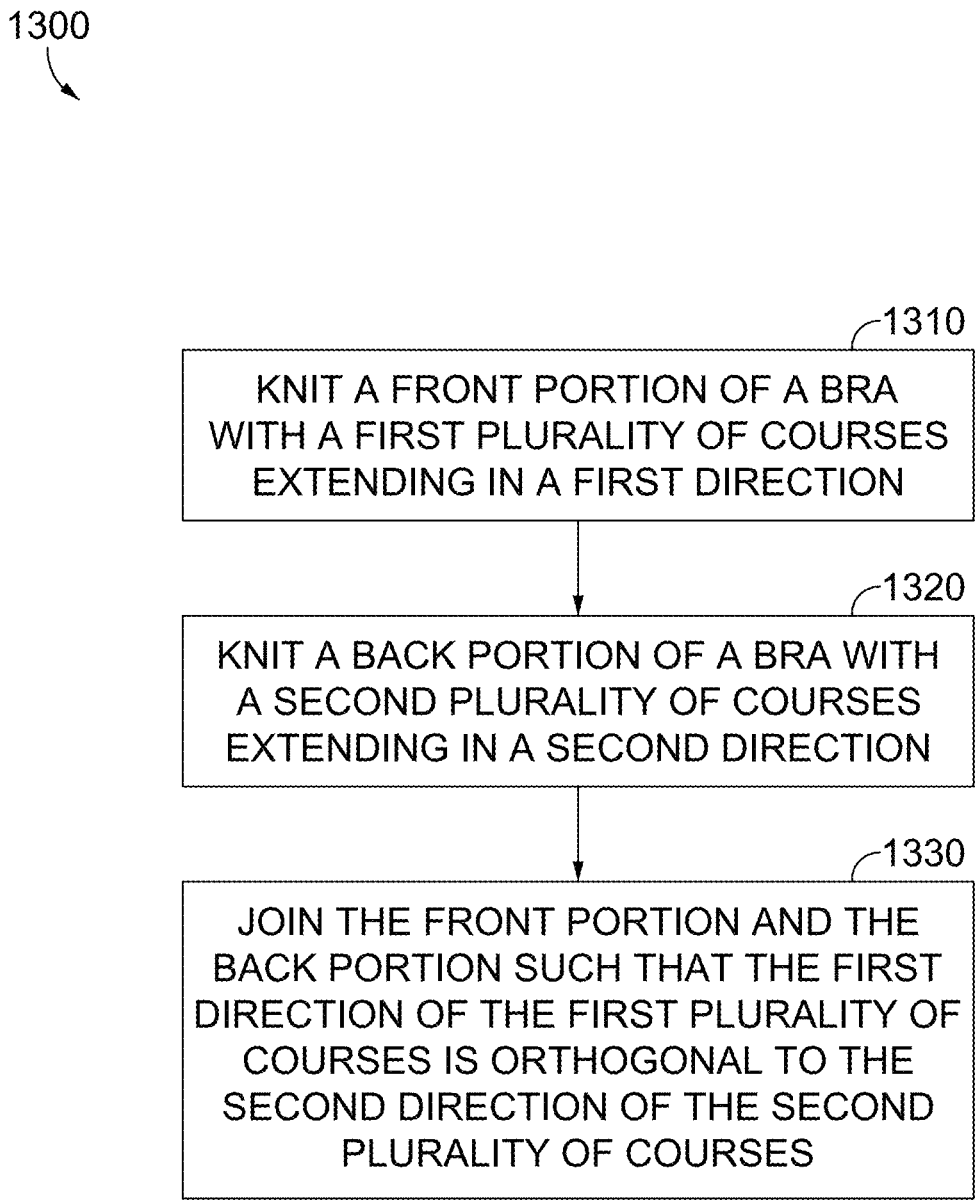
FIG. 13 illustrates a flow diagram of an example method of manufacturing a knit bra in different knitting directions in accordance with aspects herein.

Turning to FIG. 13, a flow diagram is provided depicting an example method 1300 of manufacturing a bra, such as the bra 100, with the front and back portions knitted in different directions. In example aspects, knitting steps within method 1300 are weft-knitting processes. At step 1310, a front portion, such as the front portion 110, of the bra is knitted by forming a first plurality of courses extending along a first direction. At step 1320, a back portion, such as the back portion 210, of the bra is knitted by forming a second plurality of courses extending along a second direction. In example aspects, the first direction corresponds to the front knitting direction arrow 1110 depicted in FIG. 11, and the second direction corresponds to the back knitting direction arrow 1210 in FIG. 12.

At step 1330, the method 1300 includes joining the front portion to the back portion. In example aspects, step 1330 includes affixing the front portion to the back portion by affixing a first front lateral edge (e.g., 116) to a first back lateral edge (e.g., 216) and affixing a second front lateral edge (e.g., 118) to a second back lateral edge (e.g., 218). Step 1330 may further include affixing the front strap superior edges (e.g., 196A and 196B) of the front strap portions (e.g., 192A and 192B) to back strap superior edges (e.g., 198A and 198B) of the back strap portions (e.g., such as 194A and 194) creating a neck hole for the bra. It is contemplated that method 1300 may include utilizing means of affixing the front and back portions such as by stitching, bonding, and the like.

When the front portion is joined to the back portion, the first direction of the first plurality of courses of the front portion is orthogonal to the second direction of the second plurality of courses of the back portion. In example aspects, the first direction is horizontal and the second direction is vertical when the bra is in an as-worn configuration.

In example aspects, one or both of the front portion and the back portion are knitted to have a double-knit textile structure with a plurality of front courses formed of a first yarn and a plurality of back courses formed of a second yarn. Further, one or both of the front portion and the back portion include a plurality of intermediate courses formed of a third yarn that interloops with the plurality of front courses and the plurality of back courses. In example aspects, one or more intermediate courses are knitted to have one or more tuck stitches and one or more float stitches. Additionally, when a bra having the front portion joined to the back portion is in an as-worn configuration, float stitches within the intermediate courses in the front portion may extend in a horizontal direction while float stitches within the intermediate courses in the back portion may extend in a vertical direction.

Additionally, aspects of method 1300 may further include knitting the front portion and the back portion to create flat knit edges that are free from surrounding material when the front portion and the back portion are knitted. In this way, the edges of the front portion and the back portion may be finished (e.g. without fraying or unraveling) without additional post-knitting finishing processes.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1: A bra comprising: a double-knit front portion comprising a Y-shaped region and a first breast-contacting region, the Y-shaped region having an upper right portion, an upper left portion, and a lower central portion; wherein the double-knit front portion comprises: a plurality of front courses formed by a first yarn; a plurality of back courses formed by a second yarn; and a plurality of intermediate courses formed by a third yarn interlooping with the plurality of front courses and the plurality of back courses, one or more intermediate courses of the plurality of intermediate courses having one or more tuck stitches and one or more float stitches, wherein the one or more intermediate courses of the plurality of intermediate courses each has a first ratio of float stitches to tuck stitches within the Y-shaped region and a second ratio of float stitches to tuck stitches within the first breast-contacting region, the first ratio being greater than the second ratio.

Clause 2: The bra according to clause 1, wherein the first yarn, the second yarn, and the third yarn are different colors.

Clause 3: The bra according to any of clauses 1-2, wherein the Y-shaped region is integrally knit with the first breast-contacting region.

Clause 4: The bra according to any of clauses 1-3, wherein the double-knit front portion further comprises a second breast-contacting region, wherein the lower central portion of the Y-shaped region is positioned between the first breast-contacting region and the second breast-contacting region.

Clause 5: The bra according to any of clauses 1-4, wherein the upper right portion of the Y-shaped region is positioned superior to the first breast-contacting region, and the upper left portion of the Y-shaped region is positioned superior to the second breast-contacting region.

Clause 6: The bra according to any of clauses 1-5, wherein the one or more intermediate courses each has a third ratio of float stitches to tuck stitches within the second breast-contacting region, the first ratio being greater than the third ratio.

Clause 7: The bra according to any of clauses 1-6, wherein the third ratio is substantially the same as the second ratio.

Clause 8: The bra according to any of clauses 1-7, wherein the double-knit front portion further comprises a first wing region, wherein the first breast-contacting region is positioned between the Y-shaped region and the first wing region, and wherein the one or more intermediate courses each has a fourth ratio of float stitches to tuck stitches within the first wing region, the fourth ratio being greater than the second ratio.

Clause 9: The bra of according to any of clauses 1-8, wherein the double-knit front portion comprises a second wing region, wherein the second breast-contacting region is positioned between the Y-shaped region and the second wing region, and wherein the one or more intermediate courses each has a fifth ratio of float stitches to tuck stitches within the second wing region, the fifth ratio being greater than the second ratio.

Clause 10: The bra according to any of clauses 1-9, wherein knit stitches within the Y-shaped region comprise a first knit stitch length and knit stitches within the first breast-contacting region comprise a second knit stitch length that is greater than the first knit stitch length.

Clause 11: The bra of according to any of clauses 1-10, wherein the double-knit front portion comprises a front layer comprising the plurality of front courses formed by the first yarn and a back layer comprising the plurality of back courses formed by the second yarn, wherein the one or more float stitches of the one or more intermediate courses is positioned between the front layer and the back layer.

Clause 12: The bra of claim according to any of clauses 1-11, further comprising a double-knit back portion comprising a second plurality of front courses and a second plurality of back courses, wherein the second plurality of front courses and the second plurality of back courses extend orthogonally relative to the plurality of front courses, the plurality of back courses, and the plurality of intermediate courses of the double-knit front portion.

Clause 13: A bra comprising: a double-knit front portion comprising a Y-shaped region, a first breast-contacting region, a second breast-contacting region, a first wing region, and a second wing region, the Y-shaped region having an upper right portion, an upper left portion, and a lower central portion; wherein the double-knit front portion comprises: a plurality of front courses formed by a first yarn; a plurality of back courses formed by a second yarn; and a plurality of intermediate courses formed by a third yarn interlooping with the plurality of front courses and the plurality of back courses, one or more intermediate courses of the plurality of intermediate courses having one or more tuck stitches and one or more float stitches, wherein the one or more intermediate courses of the plurality of intermediate courses each has a first ratio of float stitches to tuck stitches within the Y-shaped region, a second ratio of float stitches to tuck stitches within the first breast-contacting region, a third ratio of float stitches to tuck stitches within the second breast-contacting region, a fourth ratio of float stitches to tuck stitches within the first wing region, and a fifth ratio of float stitches to tuck stitches within the second wing region, wherein the first ratio, the fourth ratio, and the fifth ratio are each greater than the second ratio and the third ratio.

Clause 14: The bra according to clause 13, wherein the first ratio, the fourth ratio and the fifth ratio are substantially the same.

Clause 15: The bra according to any of clauses 13-14, wherein the double-knit front portion comprises a front layer comprising the plurality of front courses formed by the first yarn and a back layer comprising the plurality of back courses formed by the second yarn, wherein the one or more float stitches of the one or more intermediate courses is positioned between the front layer and the back layer.

Clause 16: The bra according to any of clauses 13-15, wherein knit stitches within the Y-shaped region comprise a first knit stitch length and knit stitches within the first breast-contacting region and the second breast-contacting region comprise a second knit stitch length that is greater than the first knit stitch length.

Clause 17: A method of manufacturing a bra, the method comprising: knitting a front portion of the bra, the front portion comprising a Y-shaped region and a first breast-contacting region, the Y-shaped region having an upper right portion, an upper left portion, and a lower central portion, wherein knitting the front portion comprises: knitting a plurality of front courses with a first yarn; knitting a plurality of back courses with a second yarn; and knitting a plurality of intermediate courses with a third yarn interlooping with the plurality of front courses and the plurality of back courses, one or more intermediate courses of the plurality of intermediate courses being knitted with one or more tuck stitches and one or more float stitches, wherein the one or more intermediate courses of the plurality of intermediate courses each has a first ratio of float stitches to tuck stitches within the Y-shaped region and a second ratio of float stitches to tuck stitches within the first breast-contacting region, the first ratio being greater than the second ratio.

Clause 18: The method of manufacturing the bra according to clause 17, wherein the front portion further comprises a second breast-contacting region that is separated from the first breast-contacting region by the Y-shaped region, wherein the one or more intermediate courses each has a third ratio of float stitches to tuck stitches within the second breast-contacting region, the third ratio being less than the first ratio.

Clause 19: The method of manufacturing the bra according to any of clauses 17-18, wherein the front portion further comprises a first wing region positioned adjacent the first breast-contacting region and a second wing region positioned adjacent the second breast-contacting region, wherein the one or more intermediate courses each has a fourth ratio of float stitches to tuck stitches within the first wing region and a fifth ratio of float stitches to tuck stitches within the second wing region, the fourth ratio and the fifth ratio each being greater than the second ratio and the third ratio.

Clause 20: The method of manufacturing the bra according to any of clauses 17-19, wherein the front portion comprises a front layer comprising the plurality of front courses formed by the first yarn and a back layer comprising the plurality of back courses formed by the second yarn, and wherein the one or more float stitches of the one or more intermediate courses is positioned between the front layer and the back layer.

Clause 21: A bra comprising: a knit front portion comprising a first plurality of courses extending along a first direction; and a knit back portion coupled to the knit front portion, the knit back portion comprising a second plurality of courses extending along a second direction that is orthogonal to the first direction.

Clause 22: The bra according to clause 21, wherein, when the bra is in an as-worn configuration, the first direction is horizontal and the second direction is vertical.

Clause 23: The bra according to any of clauses 21-22, wherein the knit front portion extends continuously from a first armhole edge of the knit front portion to a second armhole edge of the knit front portion, and wherein the knit back portion extends from a first armhole edge of the knit back portion to a second armhole edge of the knit back portion.

Clause 24: The bra according to any of clauses 21-23, wherein the knit front portion extends continuously from a neckline edge of the knit front portion to a bottom chestband edge of the knit front portion, and wherein the knit back portion extends from a neckline edge of the knit back portion to a bottom chestband edge of the knit back portion.

Clause 25: The bra according to any of clauses 21-24, wherein the knit back portion comprises a chestband portion having a top chestband edge and a bottom chestband edge, the knit back portion further comprising one or more strap portions extending from the top chestband edge.

Clause 26: The bra according to any of clauses 21-25, wherein the knit front portion and the knit back portion each are double knit.

Clause 27: The bra according to any of clauses 21-26, wherein: the first plurality of courses of the knit front portion comprises a first plurality of front courses formed by a first yarn, a first plurality of back courses formed by a second yarn, and a first plurality of intermediate courses formed by a third yarn interlooping with the first plurality of front courses and the first plurality of back courses, wherein one more intermediate courses of the first plurality of intermediate courses has one or more tuck stitches and one or more float stitches, and the second plurality of courses of the knit back portion comprises a second plurality of front courses formed by a fourth yarn, a second plurality of back courses formed by a fifth yarn.

Clause 28: The bra according to any of clauses 21-27, wherein the knit front portion comprises a Y-shaped region and a first breast-contacting region, the Y-shaped region having an upper right portion, an upper left portion, and a lower central portion, wherein the one or more intermediate courses of the first plurality of intermediate courses each has a first ratio of float stitches to tuck stitches within the Y-shaped region and a second ratio of float stitches to tuck stitches within the first breast-contacting region, the first ratio being greater than the second ratio.

Clause 29: The bra according to any of clauses 21-28, wherein the knit front portion and the knit back portion each comprises polyester yarns.

Clause 30: A bra comprising: a knit front portion comprising a first plurality of courses extending along a first direction; and a knit back portion coupled to the knit front portion, the knit back portion having a chestband portion having a bottom chestband edge and a top chestband edge, the knit back portion comprising a second plurality of courses extending along a second direction that is orthogonal to the first direction, the second direction extending from a neckline edge of the knit back portion to the bottom chestband edge of the knit back portion, the knit back portion further comprising a plurality of strap portions extending from the top chestband edge in the second direction.

Clause 31: The bra according to clause 30, wherein, when the bra is in an as-worn configuration, the first direction is horizontal and the second direction is vertical.

Clause 32: The bra according to any of clauses 30-31, wherein the knit front portion extends continuously from a first armhole edge of the knit front portion to a second armhole edge of the knit front portion, and wherein the knit back portion extends from a first armhole edge of the knit back portion to a second armhole edge of the knit back portion.

Clause 33: The bra according to any of clauses 30-32, wherein the knit front portion extends continuously from a neckline edge of the knit front portion to a bottom chestband edge of the knit front portion, and wherein the knit back portion extends from the neckline edge of the knit back portion to the bottom chestband edge of the knit back portion.

Clause 34: The bra according to any of clauses 30-33, wherein the knit front portion and the knit back portion each are double knit.

Clause 35: The bra according to any of clauses 30-34, wherein the knit back portion comprises a closure.

Clause 36: A method of manufacturing a bra, the method comprising: knitting a front portion of the bra by forming a first plurality of courses extending along a first direction; knitting a back portion of the bra by forming a second plurality of courses extending along a second direction, joining the front portion to the back portion, wherein, when the front portion is joined to the back portion, the first direction of the first plurality of courses is orthogonal to the second direction of the second plurality of courses.

Clause 37: The method of manufacturing the bra according to clause 36, wherein, when the bra is in an as-worn configuration, the first direction is horizontal and the second direction is vertical.

Clause 38: The method of manufacturing the bra according to any of clauses 36-37, wherein the front portion is knitted to extend continuously from a first armhole edge of the front portion to a second armhole edge of the front portion, and wherein the back portion is knitted to extend from a first armhole edge of the back portion to a second armhole edge of the back portion.

Clause 39: The method of manufacturing the bra according to any of clauses 36-38, where forming the first plurality of courses comprises: knitting a plurality of front courses with a first yarn to form a front layer of the front portion; knitting a plurality of back courses with a second yarn to form a back layer of the front portion; and knitting a plurality of intermediate courses with a third yarn interlooping with the plurality of front courses and the plurality of back courses, one or more intermediate courses of the plurality of intermediate courses being knitted with one or more tuck stitches and one or more float stitches.

Clause 40: The method of manufacturing the bra according to any of clauses 36-39, wherein the back portion is knitted to include a chestband portion having a top chestband edge and a bottom chestband edge, the back portion further knitted to include a plurality of strap portions each extending from the top chestband edge in the second direction.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A bra comprising:

a double-knit front portion comprising a Y-shaped region and a first breast-contacting region, the Y-shaped region having an upper right portion extending into a right shoulder strap, an upper left portion extending into a left shoulder strap, and a lower central portion;

wherein the double-knit front portion comprises:

a first plurality of front courses formed by a first yarn;

a first plurality of back courses formed by a second yarn; and a plurality of intermediate courses formed by a third yarn interlooping with the first plurality of front courses and the first plurality of back courses, one or more intermediate courses of the plurality of intermediate courses having a repeating pattern of a first set of four tuck stitches, a first two-needle float stitch, a second set of four tuck stitches, and a second two-needle float stitch, wherein the one or more intermediate courses of the plurality of intermediate courses each has a first ratio of float stitches to tuck stitches within the Y-shaped region and a second ratio of float stitches to tuck stitches within the first breast-contacting region, the first ratio being greater than the second ratio.

2. The bra of claim 1, wherein each color of the first yarn, the second yarn, and the third yarn are different from one another.

3. The bra of claim 1, wherein the Y-shaped region is integrally knit with the first breast-contacting region.

4. The bra of claim 1, wherein the double-knit front portion further comprises a second breast-contacting region, wherein the lower central portion of the Y-shaped region is positioned between the first breast-contacting region and the second breast-contacting region.

5. The bra of claim 4, wherein the upper right portion of the Y-shaped region is positioned superior to the first breast-contacting region, and the upper left portion of the Y-shaped region is positioned superior to the second breast-contacting region.

6. The bra of claim 4, wherein the one or more intermediate courses each has a third ratio of float stitches to tuck stitches within the second breast-contacting region, the first ratio being greater than the third ratio.

7. The bra of claim 6, wherein the third ratio is substantially the same as the second ratio.

8. The bra of claim 6, wherein the double-knit front portion further comprises a first wing region, the first breast-contacting region is positioned between the Y-shaped region and the first wing region, and the one or more intermediate courses each has a fourth ratio of float stitches to tuck stitches within the first wing region, the fourth ratio being greater than the second ratio.

9. The bra of claim 8, wherein the double-knit front portion comprises a second wing region, the second breast-contacting region is positioned between the Y-shaped region and the second wing region, and the one or more intermediate courses each has a fifth ratio of float stitches to tuck stitches within the second wing region, the fifth ratio being greater than the second ratio.

10. The bra of claim 1, wherein knit stitches within the Y-shaped region comprise a first knit stitch length, and knit stitches within the first breast-contacting region comprise a second knit stitch length that is greater than the first knit stitch length.

11. The bra of claim 1, wherein the double-knit front portion comprises a front layer comprising the first plurality of front courses formed by the first yarn and a back layer comprising the first plurality of back courses formed by the second yarn, wherein the one or more float stitches of the one or more intermediate courses is positioned between the front layer and the back layer.

12. The bra of claim 1, further comprising a double-knit back portion comprising a second plurality of front courses and a second plurality of back courses, wherein the second plurality of front courses and the second plurality of back courses extend orthogonally relative to the first plurality of front courses, the first plurality of back courses, and the plurality of intermediate courses of the double-knit front portion.

13. A bra comprising:

a double-knit front portion comprising a Y-shaped region, a first breast-contacting region, a second breast-contacting region, a first wing region, a second wing region, and a front chestband region, the Y-shaped region having an upper right portion, an upper left portion, and a lower central portion;

wherein the double-knit front portion comprises:

a plurality of front courses formed by a first yarn;

a plurality of back courses formed by a second yarn; and a plurality of intermediate courses formed by a third yarn interlooping with the plurality of front courses and the plurality of back courses, one or more intermediate courses of the plurality of intermediate courses having a repeating pattern of a first set of four tuck stitches, a first two-needle float stitch, a second set of four tuck stitches, and a second two-needle float stitch, wherein the one or more intermediate courses of the plurality of intermediate courses each has a first ratio of float stitches to tuck stitches within the Y-shaped region, a second ratio of float stitches to tuck stitches within the first breast-contacting region, a third ratio of float stitches to tuck stitches within the second breast-contacting region, a fourth ratio of float stitches to tuck stitches within the first wing region, and a fifth ratio of float stitches to tuck stitches within the second wing region, wherein the first ratio, the fourth ratio, and the fifth ratio are each greater than the second ratio and the third ratio, and wherein the front chestband region includes a left-side section, a central section, and a right-side section, the central section comprising an integrally knit mesh structure.

14. The bra of claim 13, wherein the first ratio, the fourth ratio and the fifth ratio are substantially the same.

15. The bra of claim 13, wherein the double-knit front portion comprises a front layer comprising the plurality of front courses formed by the first yarn and a back layer comprising the plurality of back courses formed by the second yarn, wherein the one or more float stitches of the one or more intermediate courses is positioned between the front layer and the back layer.

16. The bra of claim 13, wherein knit stitches within the Y-shaped region comprise a first knit stitch length, and knit stitches within the first breast-contacting region and the second breast-contacting region comprise a second knit stitch length that is greater than the first knit stitch length.

17. A method of manufacturing a bra, the method comprising:

knitting a double-knit front portion of the bra, the front portion comprising a Y-shaped region and a first breast-contacting region, the Y-shaped region having an upper right portion extending into a right shoulder strap, an upper left portion extending into a left shoulder strap, and a lower central portion, wherein knitting the front portion comprises:

knitting a plurality of front courses with a first yarn;

knitting a plurality of back courses with a second yarn; and knitting a plurality of intermediate courses with a third yarn interlooping with the plurality of front courses and the plurality of back courses, one or more intermediate courses of the plurality of intermediate courses being knitted with a repeating pattern of a first set of four tuck stitches, a first two-needle float stitch, a second set of four tuck stitches, and a second two-needle float stitch, wherein the one or more intermediate courses of the plurality of intermediate courses each has a first ratio of float stitches to tuck stitches within the Y-shaped region and a second ratio of float stitches to tuck stitches within the first breast-contacting region, the first ratio being greater than the second ratio.

18. The method of manufacturing the bra of claim 17, wherein the front portion further comprises a second breast-contacting region that is separated from the first breast-contacting region by the Y-shaped region, wherein the one or more intermediate courses each has a third ratio of float stitches to tuck stitches within the second breast-contacting region, the third ratio being less than the first ratio.

19. The method of manufacturing the bra of claim 18, wherein the front portion further comprises a first wing region positioned adjacent the first breast-contacting region and a second wing region positioned adjacent the second breast-contacting region, wherein the one or more intermediate courses each has a fourth ratio of float stitches to tuck stitches within the first wing region and a fifth ratio of float stitches to tuck stitches within the second wing region, the fourth ratio and the fifth ratio each being greater than the second ratio and the third ratio.

20. The method of manufacturing the bra of claim 17, wherein the front portion comprises a front layer comprising the plurality of front courses formed by the first yarn and a back layer comprising the plurality of back courses formed by the second yarn, and wherein the one or more float stitches of the one or more intermediate courses is positioned between the front layer and the back layer.

* * * * *